US007588432B2

(12) United States Patent
Takagi et al.

(10) Patent No.: US 7,588,432 B2
(45) Date of Patent: Sep. 15, 2009

(54) PUMP AND INKJET PRINTER

(75) Inventors: Osamu Takagi, Aichi-ken (JP); Yasuhiro Shimizu, Mizuho (JP); Susumu Kuzuya, Gifu (JP); Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 814 days.

(21) Appl. No.: 10/790,827

(22) Filed: Mar. 3, 2004

(65) Prior Publication Data

US 2004/0174401 A1 Sep. 9, 2004

(30) Foreign Application Priority Data

Mar. 5, 2003 (JP) ..... 2003-058127
Mar. 5, 2003 (JP) ..... 2003-058135
Mar. 25, 2003 (JP) ..... 2003-082883

(51) Int. Cl.
*F04C 2/00* (2006.01)
*F04C 2/344* (2006.01)
*B41J 2/17* (2006.01)
*B41J 2/175* (2006.01)

(52) U.S. Cl. ..... 418/255; 418/254; 123/235; 123/243; 347/85; 347/92

(58) Field of Classification Search ..... 418/254, 418/255; 123/235, 242, 243; 347/85, 92
See application file for complete search history.

(56) References Cited

U.S. PATENT DOCUMENTS 1,442,198 A * 1/1923 Utley et al. ..... 418/255
1,719,135 A * 7/1929 Roessler ..... 418/255
1,952,834 A * 3/1934 Beidler et al. ..... 418/255
1,972,744 A * 9/1934 Lister ..... 418/255
2,278,740 A * 4/1942 Roessler ..... 418/255
2,359,903 A * 10/1944 Fanning ..... 418/255
2,373,656 A * 4/1945 Brull ..... 418/254
2,410,596 A * 11/1946 Bradford ..... 418/255
2,903,971 A * 9/1959 Collins ..... 418/255
4,133,617 A 1/1979 Reynaud
4,380,770 A * 4/1983 Maruyama ..... 347/29
6,561,637 B2 * 5/2003 Hino ..... 347/92

(Continued)

FOREIGN PATENT DOCUMENTS

CH 249478 6/1947

(Continued)

OTHER PUBLICATIONS

"27.13 Cary's rotary pump 1"; New Fundamentals of Machine 10th Edition, 1977, Committee for republish of Fundamentals of Machine, Rikogakusha Publishing Co., Ltd. p. 203.

*Primary Examiner*—Thomas E Denion
*Assistant Examiner*—Mary A Davis
(74) *Attorney, Agent, or Firm*—Oliff & Berridge, PLC

(57) ABSTRACT

A pump includes a case, a rotor, and a partition member. The case has a hollow inside defined by an inner wall surface thereof and includes a suction inlet through which fluid is sucked in the hollow and an exhaust outlet through which the fluid is ejected from the hollow. The rotor is rotatable in the hollow. The partition member is supported with respect to the rotor in the direction across the rotor such that two ends make constant contact with the inner wall surface defining the hollow, and is rotatable with the rotor. When the rotor is rotated, the partition member slides in the direction across the rotor and expands and shrinks in the same direction, thereby the two ends of the partition member make constant contact with the inner wall surface of the case. Accordingly, the fluid is sucked through the suction inlet in the hollow and the sucked fluid is ejected through the exhaust outlet from the hollow.

20 Claims, 13 Drawing Sheets

U.S. PATENT DOCUMENTS

| | | | | |
|---|---|---|---|---|
| 6,688,865 | B1 | 2/2004 | Matsumoto et al. | |
| 7,004,573 | B2 | 2/2006 | Hewitt | |
| 7,360,878 | B2 * | 4/2008 | Takagi | 347/85 |
| 7,393,090 | B2 * | 7/2008 | Takagi | 347/85 |

FOREIGN PATENT DOCUMENTS

| | | | |
|---|---|---|---|
| DE | 1 242 100 | | 6/1967 |
| EP | 933532 | A2 * | 8/1999 |
| GB | 18254 | | 8/1912 |
| JP | U-50-73910 | | 11/1973 |
| JP | U-57-69993 | | 10/1980 |
| JP | A-57-095472 | | 6/1982 |
| JP | Y2 57-58393 | | 12/1982 |
| JP | A-60-002367 | | 1/1985 |
| JP | A-62-161545 | | 7/1987 |
| JP | A-3-292150 | | 12/1991 |
| JP | A-4-53754 | | 2/1992 |
| JP | B2 7-80304 | | 8/1995 |
| JP | B2 2721001 | | 11/1997 |
| JP | A-2001-132672 | | 5/2001 |
| JP | A 2001-353881 | | 12/2001 |
| JP | A-2002-54580 | | 2/2002 |
| JP | A-2003-533379 | | 11/2003 |
| WO | WO 98/03794 | | 1/1998 |
| WO | WO 98/42984 | | 10/1998 |

* cited by examiner

PUMP AND INKJET PRINTER

BACKGROUND OF THE INVENTION

1. Field of Invention

The invention relates to a pump and an inkjet printer having the pump.

2. Description of Related Art

Inkjet printers eject ink drops from nozzles formed on inkjet heads by making use of various principles to print desired images on sheets, which are recording media. The inkjet heads are connected via tubes to ink tanks, which are ink sources. During printing, ink is sucked from the ink tanks using the capillary action of the nozzles and negative pressure generated by ejecting ink drops from the nozzles. However, when bubbles are trapped in the ink, it is tough to suck the ink from the ink tanks. As such, images cannot be printed on sheets using the inkjet heads.

An inkjet printer disclosed in Japanese Patent Publication No. 7-80304 (pp. 3-5, FIG. 1) can solve such a problem. This printer is provided with a pump for purging, and inkjet heads (recording heads) and ink tanks (ink cartridges) each containing ink that is communicated via flexible tubes inserted through the pump. The pump has a rotor rotatably attached inside to which three rollers are disposed on the circumference of the rotor. The rollers are placed away from each other at equivalent angles and are rotatably supported via respective shafts. In addition, the flexible tubes are disposed between the outside diameter of the rotor and the inside diameter of a circular hollow in the pump. During printing in such a printer, the rollers of the rotor are disposed so that they do not crush the tubes, and ink is sucked from the ink tanks via the tubes to the inkjet heads by the capillary action of the nozzles and negative pressure generated by ejecting ink drops from the nozzles as described above. Then, ink drops are ejected from the nozzles of the inkjet heads, and images are thereby printed on sheets. For a purging operation, the rotor of the pump is rotated so that ink is forcibly supplied from the pump to the inkjet heads. As this rotation enables ink containing bubbles to be eliminated from the inkjet heads, the reliability of the ink supply state can be recovered.

However, in the inkjet printer disclosed in Japanese Patent Publication No. 7-80304, when ink is forcibly supplied to the inkjet heads, the rotor crushes the flexible tubes at a position where the rotor contacts the flexible tubes when the rotor rotates. As a result, there is a problem in that the tubes disposed in the pump are damaged, and the ink supply to the inkjet heads fails.

There also exists a Cary's rotary pump, as a kind of rotary pump, as shown in FIG. 1. The pump 1070 has a case 1073 where a suction inlet 1071 and an exhaust outlet 1072 are formed and a rotor 1074 is rotatably provided so as to make contact with an inner surface of an upper portion of the case 1073 between the suction inlet 1071 and the exhaust outlet 1072. The rotor 1074 is provided at an eccentric position in the case 1073. Two vanes 1076*a*, 1076*b* connected by a spring 1075 are disposed in the rotor 1074 so as to slide in a direction of the diameter of the rotor 1074. When the rotor 1074 rotates, the two vanes 1076*a*, 1076*b* rotate while making contact with the inner surface of the case 1073 by a spring force and a centrifugal force generated by rotating the rotor 1074.

In the pump 1070 as described, when the rotor 1074, which is located at the eccentric position, rotates, the volume gradually expands in a chamber communicating with the suction inlet 1071 (i.e., chamber 1077*a* in FIG. 1), and fluid (liquid or gas) is sucked through the suction inlet 1071 therein to with the expansion of the volume. The chamber where the fluid is sucked then shifts to a position that is out of communication with the suction inlet 1071 and the exhaust outlet 1072 (i.e., chamber 1077*b* in FIG. 1) by rotating the rotor 1074. The chamber then moves to a position in communication with the exhaust outlet 1072 (i.e., chamber 1077*c* in FIG. 1), where the volume is gradually decreased and the fluid is conveyed through the exhaust outlet 1072 with the decrease of the volume.

The above-described Cary's pump is disclosed in the following document: "27.13 Cary's rotary pump 1" in "Shin kikai no moto 10 pan 1977" [New Fundamentals of Machine 10th edition, 1977]. ed. Kikai no moto fukkan iinkai [Committee for republish of Fundamentals of Machine]. Rikogakusha Publishing Co., Ltd. p 203.

SUMMARY OF THE INVENTION

However, the Cary's rotary pump 1070 is intricately structured because the number of parts are large, and the manufacturing cost is thus expensive. If the spring 1075 becomes damaged, the vanes 1076*a*, 1076*b* do not move smoothly in the diameter direction by rotating the rotor 1074. Thus, it becomes difficult to suck water or air through the suction inlet 1071, resulting in a pump failure.

The invention thus provides, among other things, a pump that is not likely to malfunction and simply structured to thereby reduce manufacturing costs, and an inkjet printer including such a pump.

In one exemplary aspect of the invention, a pump includes a case having a hollow inside defined by an inner wall surface thereof and including a first through hole through which fluid is sucked in the hollow and a second through hole through which the fluid is ejected from the hollow; a rotor that is rotatable in the hollow and having a rotary shaft and a through groove formed on the rotor in a direction across the rotary shaft; and a partition in the through groove slidably in the direction across the rotary shaft, the partition being rotatable with the rotor with at least both ends of the partition, with respect to the direction across the rotary shaft, in constant contact with the inner wall surface defining the hollow upon rotation of the rotor. The hollow is partitioned into a plurality of chambers each enclosed by the case, the rotor, and the partition.

According to the above structure, upon rotation of the rotor, the partition slides in the direction across the rotor in accordance with a pressing force exerting on the inner wall surface of the case while expanding and contracting. Thus, as both ends of the partition is in constant contact with the inner wall surface of the case, the fluid can be sucked from the first through hole into the hollow and the sucked fluid can be ejected from the second through hole. Accordingly, the pump is simpler in structure and has less trouble when compared with the relevant prior art pump using two vanes urged by a spring instead of the partition member. In addition, as the pump does not use a spring, the number of parts can be decreased and manufacturing costs can be reduced.

BRIEF DESCRIPTION OF THE DRAWINGS

Embodiments of the invention will be described in detail with reference to the following figures wherein.

DETAILED DESCRIPTION OF PREFERRED EMBODIMENTS

Figure 1:
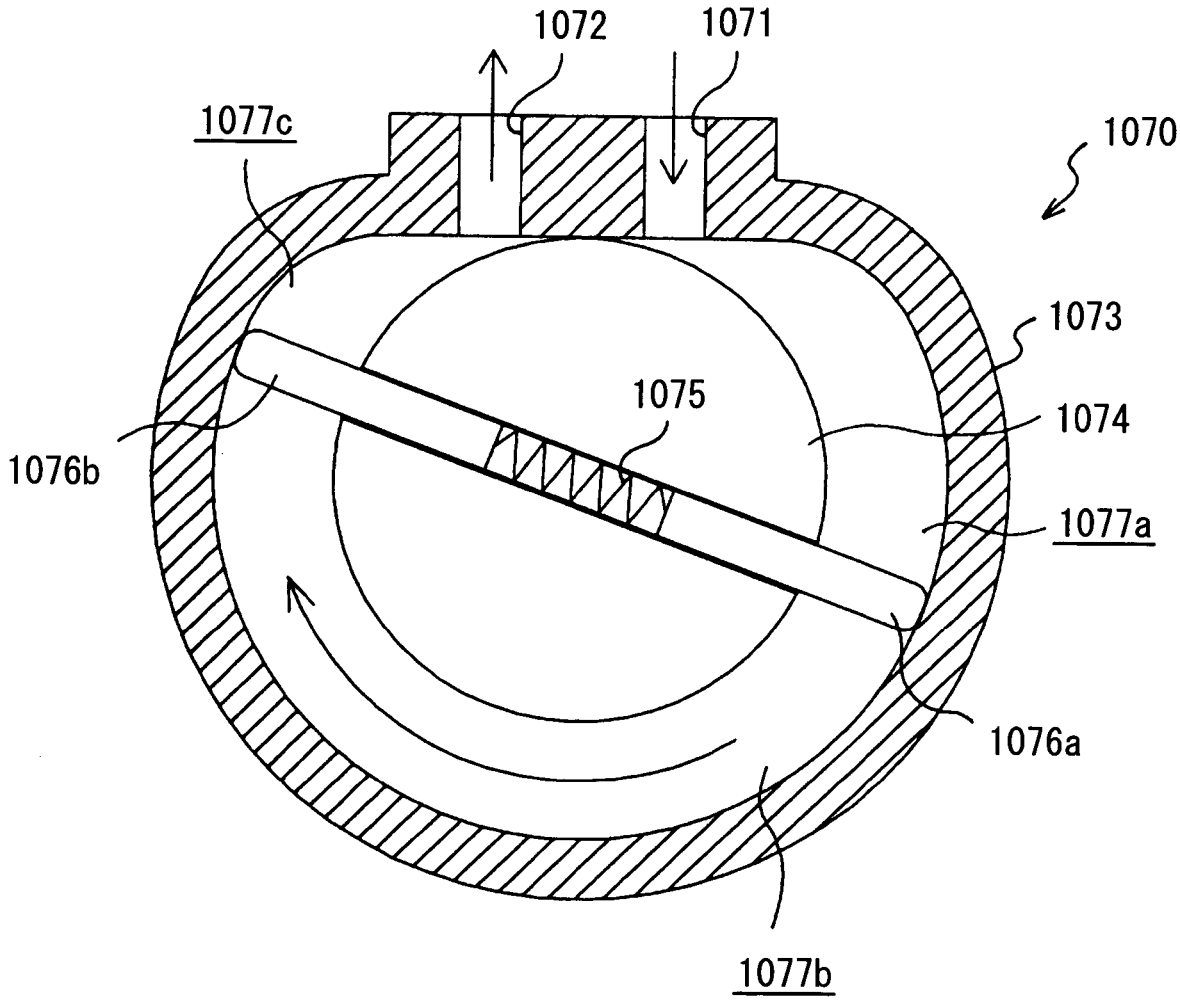
FIG.1 (Related Art)
FIG. 1 is a schematic sectional view of a conventional rotary pump.
Figure 2:
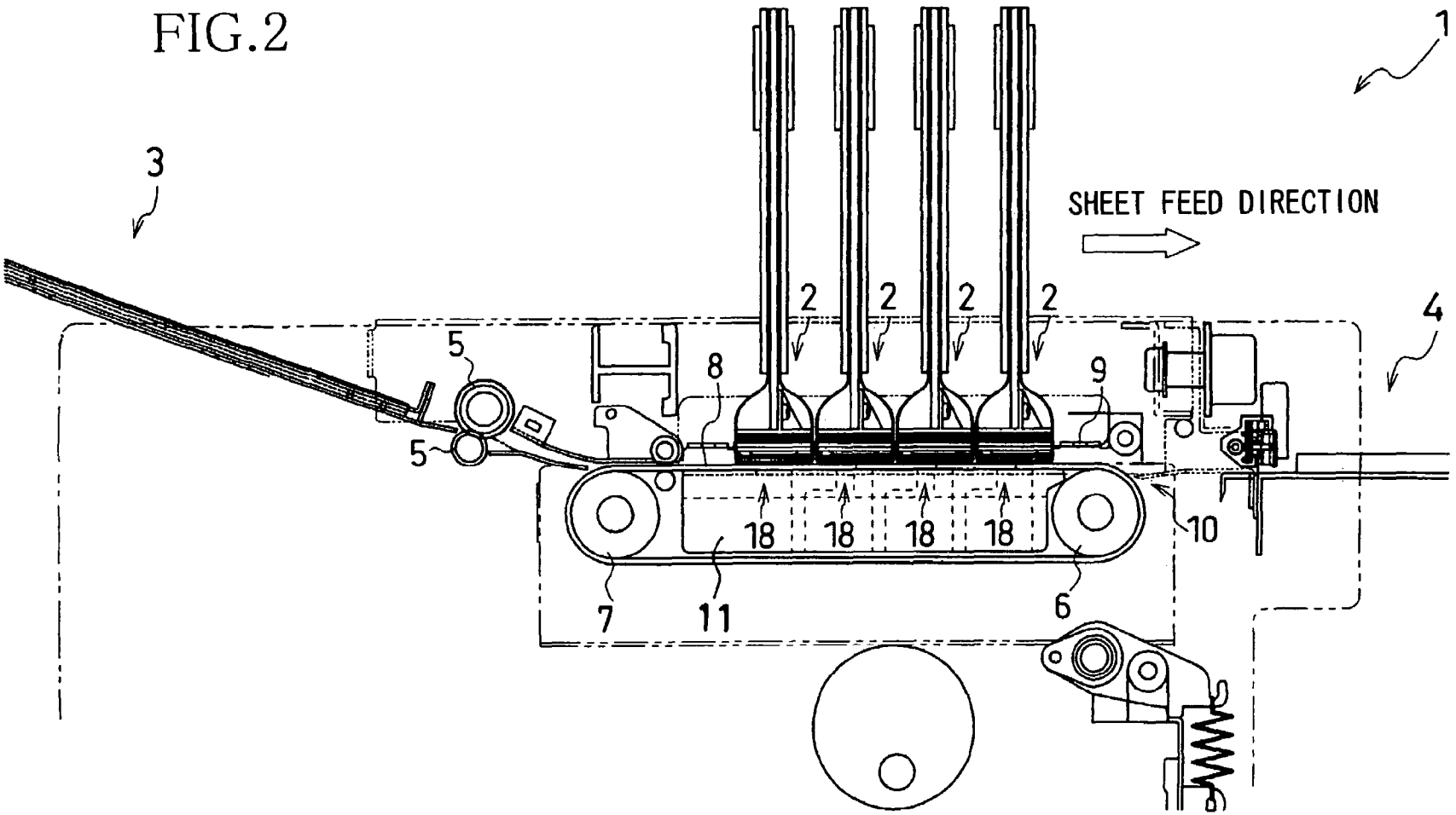
FIG. 2 is a side view showing a general structure of an inkjet printer to which a pump according to an embodiment of the invention is applied.

An embodiment of the invention will be described in detail with reference to the accompanying drawings. A general structure of an inkjet printer 1 will be described with reference to FIG. 2. The inkjet printer 1 shown in FIG. 2 is a color inkjet printer having four inkjet heads 2. The printer 1 is provided with a sheet supplying unit 3 on the left of FIG. 2 and a sheet ejecting unit 4 on the right.

Inside the printer 1, a sheet conveying path is formed from the sheet supplying unit 3 toward the sheet ejecting unit 4. A pair of conveying rollers 5 are disposed just downstream of the sheet supplying unit 3. A sheet is conveyed by the pair of conveying rollers 5 from left to right in the figure (in the sheet conveying direction). Two belt rollers 6, 7 and a conveyor belt 8, which is endless and looped around the two belt rollers 6, 7, are disposed in the middle of the sheet conveying path. An outer surface (a conveying surface) of the conveyor belt 8 is treated with silicon so that the sheet conveyed by the pair of conveying rollers 5 is held on the outer surface of the conveyor belt 8 by its adhesive strength and is conveyed downstream (rightward in the figure) through a drive of the belt roller 6. A pressing member 9 is disposed opposite the belt roller 6 with respect to the sheet conveying path. The pressing member 9 is used to bring a sheet into intimate contact with a conveying surface of the conveyor belt 8 by pressing the sheet against the conveying surface, so that the sheet is not raised from the conveying surface.

A sheet separation mechanism 10 is disposed rightward from the conveyor belt 8 as shown in the drawing. The sheet separation mechanism 10 is designed to separate a sheet adhered on the conveyor belt 8 from the conveyor belt 8 and convey the sheet to the sheet ejecting unit 4.

A guide member 11 is disposed in an area enclosed with the conveyor belt 8. The guide member 11 has a substantially rectangular parallelepiped (having a width as nearly the same as the conveyor belt 8) and is placed opposite the inkjet heads 2 in contact with a lower surface of an upper portion of the conveyor belt 8, thereby supporting the conveyor belt 8 from the inner surface of the conveyor belt 8.

The four inkjet heads 2 are arranged corresponding to the four color inks (magenta, yellow, cyan, and black) along the sheet conveying direction. That is, the printer 1 is a line printer. Each of the inkjet heads 2 has a rectangular shape having a longitudinal direction perpendicular to the sheet conveying direction when viewed in a plan view, and includes a corresponding head body 18 on a lower end thereof. Each head body 18 is made by affixing a fluid passage unit, in which an ink passage including a pressure chamber is formed, to an actuator that applies pressure to ink in the pressure chamber. Each head body 18 has, on a bottom surface, a plurality of ejection nozzles having very minute diameters through which ink is ejected downward.

The inkjet heads 2 are arranged so as to create a small clearance between the bottom surfaces of the inkjet heads 2 and the outer surface of the conveyor belt 8, with the sheet conveying path formed in the clearance. With this structure, a sheet conveyed on the conveyor belt 8 passes directly under the head bodies 18 of the four inkjet heads 2, each color ink is ejected from the nozzles on an upper surface (print surface) of the sheet, and a desired color image can be formed on the sheet.

Figure 3:
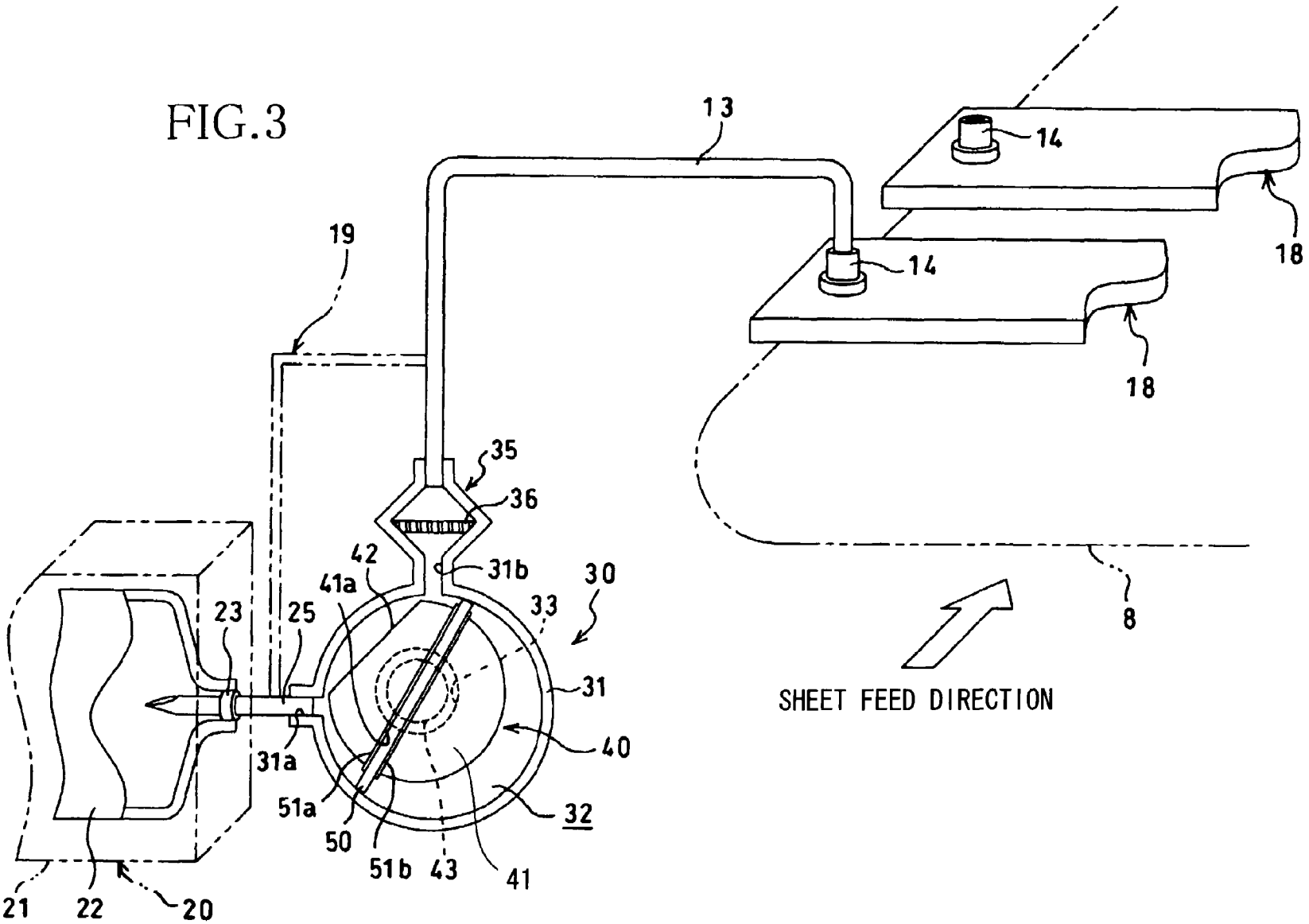
FIG. 3 is a schematic diagram showing an ink supply passage of the inkjet printer shown in FIG. 2.

A structure for supplying ink to the inkjet heads 2 in the inkjet printer 1 will be described with reference to FIG. 3. To supply different color inks to the respective inkjet heads 2, an ink tank 20 is provided in an appropriate position within the printer 1 as shown in FIG. 3. The inkjet head 2 and the ink tank 20, which are positioned away from each other, are connected via a pump 30 and a flexible tube 13 connected to the pump 30. Thus, an ink supply passage (ink passage) from the ink tank 20 to the inkjet head 2 is created. In FIG. 3, one ink tank 20, one pump 30 and one tube 13 are illustrated. However, there are actually four ink tanks 20 and four pumps 30 to correspond to the number of the inkjet heads 2.

As shown in FIG. 3, the ink tank 20 includes an ink bag 22 in a synthetic resin housing 21. The ink bag 22 contains degassed ink. The ink bag 22 has a resin spout that seals an opening of the bag 22. The spout is provided with a cap 23 made from silicon or butyl rubber. The ink bag 22 is constructed from a pouch film formed by sealing a plurality of flexible films by heat. The pouch film is structured wherein a polypropylene layer on an innermost side, a polyester layer as a base placed on the polypropylene layer, an aluminum foil layer as an impermeable layer placed on the polyester layer, and a nylon layer for improving the strength of the film are laminated in this order.

A hollow needle 25 passes through the cap 23. When ink in the ink tank 20 runs out, the hollow needle 25 is separated from the cap 23, and the ink tank 20 is replaced with a new one.

Each head body 18 of the inkjet heads 2 includes a tubular member 14 on one end with respect to a longitudinal direction thereof and on a surface opposite from the bottom surface where the ejection nozzles are formed. One end of the tube 13 connected to the pump 30 is connected to the tubular member 14. Ink in the ink tank 20 is led to the ink passage inside the head body 18 and ejected from the nozzles. The tube 13 has a tubular shape and has sufficient flexibility because it is made from an elastomer.

Next, a structure of the pump 30 will be described with reference to FIGS. 3 and 4A to 4C. The pump 30 shown in FIG. 3 includes a cylindrical-shaped case 31 with end surfaces in an axial direction thereof. For that, a hollow 32 (i.e., an interior) is defined in the case 31. An opening 33, where a rotary shaft 43 of the rotor 40 passes through, is formed on one end surface of the case 31. A suction inlet 31*a* through which ink is sucked from the ink tank 20 into the hollow 32 of the pump 30 is formed on a peripheral surface of the case 31 at a position facing the cap 23 of the ink tank 20. The hollow needle 25, which is made of metal and has a cylindrical shape, is directly coupled to the suction inlet 31*a*. An end of the hollow needle 25, which faces toward the ink tank 20, is sharp because it is cut at a bevel. As shown in FIG. 3, the hollow needle 25 connected to the suction inlet 31*a* passes through the cap 23 of the ink tank 20 horizontally, thereby forming the ink passage between the ink tank 20 and the pump 30. Ink in the ink bag 22 is taken in via the hollow needle 25 from the suction inlet 31*a* into the hollow 32 of the pump 30.

An exhaust outlet 31*b* through which ink is ejected from the hollow 32 to the inkjet head 2 is formed at a place rotated 90 degrees clockwise in FIG. 3 from the suction inlet 31*a* on the peripheral surface of the case 31 (in other words, in an upper vertical position on the peripheral surface of the case 31). The exhaust outlet 31*b* is connected to a filter storing portion 35, which is connected to the tube 13 connected to the tubular member 14 of the head body 18. Inside the filter storing portion 35, a communication hole is formed so as to vertically face a passage from the exhaust outlet 31*b* to the tube 13. The communication hole forms a part of the ink passage from the ink tank 20 to the inkjet head 2. The communication hole expands horizontally at a substantially middle portion thereof, where a filter 36 is disposed such that its filter face is positioned horizontally.

The filter 36 is a mesh filter and is designed to filter ink supplied from the ink tank 20 to the inkjet head 2. Thus, the filter 36 catches foreign materials, such as rubber leavings caused by the insertion and removal of the hollow needle 25 to and from the cap 23, so that they can be removed from ink. As a result, there is no need to specially provide a filter structure to the ink tank 20 side, and a simplification of the ink tank can be obtained.

The horizontal arrangement of the filter 36 provides a structure in which bubbles, trapped in ink, easily pass through the filter 36 when ink is sucked in an empty hollow 32 of the pump 30 (when ink is initially sucked). This occurs because a comparatively great force combining the buoyancy of the bubbles and the rotation force of the pump 30 is applied to the bubbles in the ink. Thus, the supply of ink to the inkjet head 2 is less often interrupted due to stagnation of a large amount of bubbles at an upstream side of the filter 36. Further, by forming the exhaust outlet 31*b* on an upper vertical side of the case 31, bubbles trapped in the hollow 32 when ink is initially sucked can be smoothly ejected without opposing the buoyancy, thereby obtaining high ejection quality.

As shown in FIG. 3, the case 31 of the pump 30 includes a rotor 40 rotatably at a specified position therein. The rotor 40 is comprised of a rotating part 41 that rotates in the case 31 and the rotary shaft 43 that transmits a rotational force to the rotating part 41. The rotating part 41 of the rotor 40 has a cylindrical shape and a thickness such that both end surfaces with respect to its axial direction are in contact with both end wall surfaces defining the hollow 32 (both inner end surfaces of the case 31). The rotary shaft 43 is cylindrically shaped and is formed on one end surface of the rotating part 41, protruding in the axial direction of the rotating part 41 in engagement with an opening 33 formed on the one end surface of the case 31. A gear (not shown) is disposed on a part of the peripheral surface of the rotary shaft 43 and is in constant contact with part of the peripheral surface of the rotary shaft 43. When the gear is rotated by a drive unit (not shown), the rotating part 41 rotates via the rotary shaft 43.

The rotating part 41 of the rotor 40 includes a through part 41*a*, which is formed in a diameter direction of the rotating part 41 and passes through the peripheral surface of the rotating part 41 (a circumferential surface of a cylinder). The through part 41*a* is formed in such a shape as to have a very small clearance in which two sliding members 51*a*, 51*b* and a partition member 50 are disposed to overlay each other and move along the inner surface of the through part 41*a*.

As shown in FIG. 3, the partition member 50, made from an ethylene-propylene-diene-terpolymer (EPDM)-base synthetic rubber, and the two sliding members 51*a*, 51*b*, disposed such as to sandwich the partition member 50 therebetween, are disposed in the through part 41*a* of the rotating part 41 across the rotating part 41 on the center thereof. The partition member 50 and the sliding members 51*a*, 51*b* are disposed such that both of their ends with respect to their longitudinal direction (with respect to a direction across the rotating part 41 of the rotor 40) extend from the peripheral surface of the rotating part 41. The partition member 50 is a flexible member and can extend in its longitudinal direction. The sliding members 51*a*, 51*b* are made from acetal polyoxymethylene (POM) resin.

The partition member 50 has a rectangular, flat board shape, and at least, a length such that both end surfaces of the partition member 50 with respect to its longitudinal direction are in contact with at least the inner surface of the case 31 (wall surface defining the hollow 32 in the case 31). The partition member 50 has a thickness greater than that of one sliding member. With the partition member 50 constructed above, the hollow 32 in the case 31 is always divided into two chambers.

The two sliding members 51*a*, 51*b* are physically similar to the partition member 50 except for that the two sliding members 51*a*, 51*b* are shorter and thinner than the partition member 50. As the sliding member 51*a*, 51*b* are constructed from resin, the sliding friction coefficient of the sliding members 51*a*, 51*b* to the through part 41*a* is smaller than the sliding friction coefficient of the partition member 50 to the through part 41*a*. Thus, the partition member 50, which is sandwiched between the sliding members 51*a*, 51*b* in the through part 41, is able to move smoothly on the inner surface of the through part 41 in a direction across the rotating part 41 of the rotor 40. Thus, when compared to a case without the sliding members 51*a*, 51*b*, when the rotor 40 rotates, the sliding members 51*a*, 51*b* allow the partition member 50 to move smoothly in the rotating part 41, resulting in an improvement of the reliability of the pump 30.

As the sliding members 51*a*, 51*b* are shorter than the partition member 50, when the rotor 40 rotates by the drive device (not shown), contact between both end surfaces of the sliding members 51*a*, 51*b* and the inner surface of the case 31 is controlled. In addition, the sliding members 51*a*, 51*b* can prevent the partition member 50 from becoming excessively curved at both ends by friction between both ends of the partition member 50 and the inner surface of the case 31. Accordingly, both ends of the partition member 50 are prevented from becoming crimped between the peripheral surface of the rotating part 41 and the inner surface of the case 31. Thus, during rotation of the rotor 40, an excessive rotational torque is not generated and the contact between both end surfaces of the sliding members 51*a*, 51*b* and the inner surface of the case 31 can be stabilized, thereby the sealability of each chamber partitioned by the partition member 50 can be stabilized.

Figure 4C:
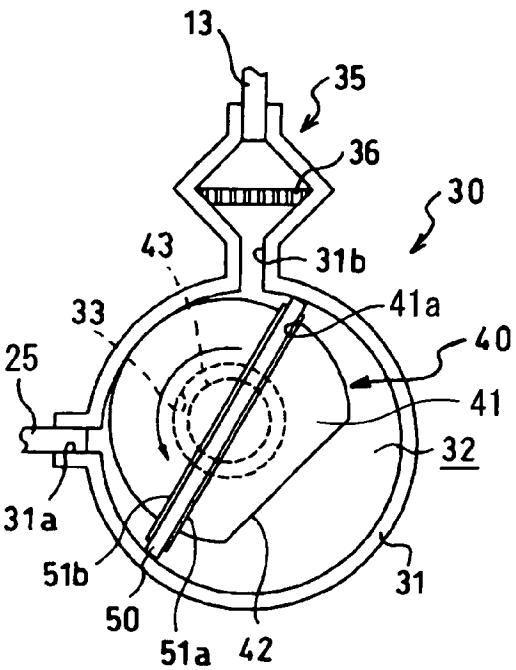
FIGS. 4B and 4C show a rotation transition of a rotor in the pump during purging.
Figure 4B:
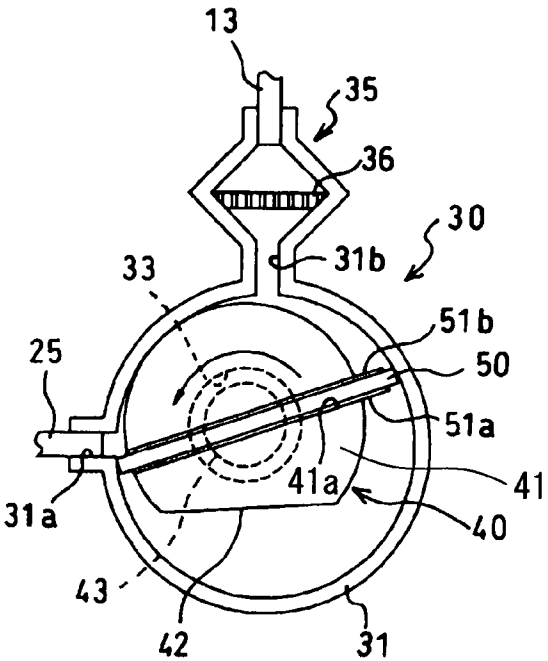
Figure 4A:
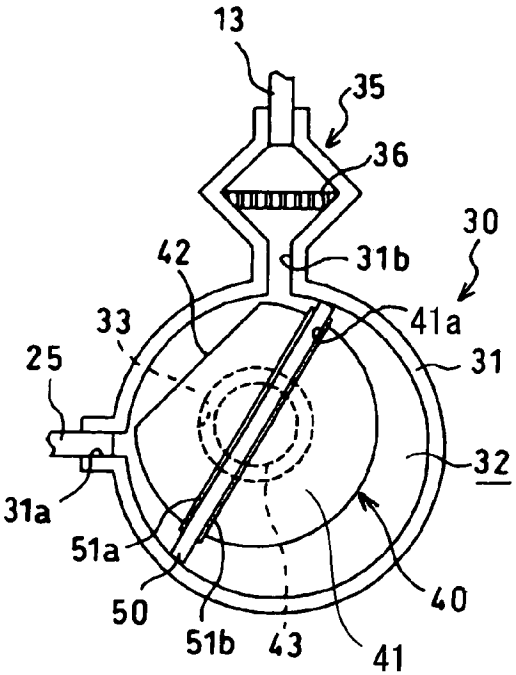
FIG. 4A shows a state of a pump applied to the inkjet printer shown in FIG. 2, during printing.

A cut portion 42, which is partially a flat and level surface, is formed on the peripheral surface of the rotating part 41 of the rotor 40 (the circumferential surface of the cylinder) so as not to overlap the through part 41*a*. As shown in FIG. 4A, when the cut portion 42 is located in a chamber, where the suction inlet 31*a* and the exhaust outlet 31*b* are present and the hollow 32 is partitioned by the partition member 50, the suction inlet 31*a* and the exhaust outlet 31*b* are in communication with each other. Thereby an ink passage is formed in the pump 30.

The rotating part 41 of the rotor 40 is also disposed at a position such that the peripheral surface of the rotating part 41, where the cut portion 42 is not formed, can contact an upper left portion (a specified position) of the inner peripheral surface of the case 31. As shown in FIGS. 4B and 4C, the rotating part 41 can contact an upper left portion of the inner peripheral surface of the case 31. Thus, it is possible to close the ink passage from the suction inlet 31*a* to the exhaust outlet 31*b* by rotating the rotor 40, thereby changing a flow resistance in the passage.

The following will describe how ink is supplied to the inkjet head 2 via the pump 30 during printing in the inkjet printer 1. Ink drops are ejected from the inkjet head 2 onto a sheet fed by the conveyor belt 8, so that a desired image is printed on the sheet. When ink drops are ejected from the nozzles of the head body 18, a negative pressure is generated in the head body 18, and the inkjet head 2 draws in ink from the ink bag 22 of the ink tank 20 by suction through the use of the negative pressure and capillary action of the nozzles.

Thus, in the pump 30 that forms a part of the ink passage between the inkjet head 2 and the ink tank 20 while the inkjet head 2 draws in ink, the rotor 40 is stopped at a position such that the cut portion 42 of the rotating part 41 are located in the chamber where the suction inlet 31*a* and the exhaust outlet 31*b* are present in the hollow 32 of the case 31, which is divided by the partition member 50, as shown in FIGS. 3 and 4A.

That is, with the cut portion 42 of the rotating part 41, a clearance is formed between the rotor 40 and the inner peripheral surface of the case 31. The clearance provides the ink passage where the suction inlet 31*a* and the exhaust outlet 31*b* are in communication with each other in the pump 30 and where the ink passage from the inkjet head 2 to the ink tank 20 is provided, so that ink is supplied to the inkjet head 2. In addition, the flow resistance in the passage from the suction inlet 31*a* to the exhaust outlet 31*b* in the pump 30 becomes low, and the ink tank 20 and the inkjet head 2 are communicated with low resistance in the pump 30. Thus, during printing, ink is supplied as required from the ink tank 20 to the inkjet head 2 via the pump 30 in accordance with ejection of ink from the inkjet head 2.

The following will describe the pump operation during purging in the inkjet printer 1. When the purging of bubbles trapped in the ink is conducted, for example after replacing the ink tank 20, the pump 30 causes the gear to be rotated by the drive device (not shown) and then the rotor 40 to be rotated from a state shown in FIG. 4A. The pump 30 can forcibly send ink only with the rotation of the rotor 40. In other words, when the rotor 40 is rotated in a direction of an arrow as shown in FIG. 4B, the peripheral surface of the rotor 40, except for the cut portion 42, makes contact with the inner peripheral surface of the case 31 and the ink passage from the suction inlet 31*a* to the exhaust outlet 31*b* is closed. Thereby the hollow 32 is divided into three chambers: a chamber that is communicating with the suction inlet 31*a*, a chamber communicating with the exhaust outlet 31*b*, and a chamber not communicating with the suction inlet 31*a* or the exhaust outlet 31*b*. Then, when the rotor 40 is further rotated in the direction of the arrow as shown in FIG. 4C, the chamber communicating with the suction inlet 31*a* expands, a negative pressure is generated in the chamber, and ink is sucked from the ink tank 20. On the other hand, the chamber communicating with the exhaust outlet 31*b* shrinks with the rotation of the rotor 40 and ink remaining in the chamber is forcibly sent from the exhaust outlet 31*b* to the inkjet head 2.

With the rotation of the rotor 40, the partition member 50 and the sliding members 51*a*, 51*b*, disposed in the through part 41*a* of the rotating part 41, slide on the inner surface of the through part 41*a* as shown in FIG. 4C from a state shown in FIG. 4B and move toward a direction across the through part 41*a* of the rotor 40. Namely, by rotating the rotor 40, on the partition member 50 shown in FIG. 4B with respect to the direction across the rotating part 41, a downward pressing force, which is generated at the contact portion between the upper end surface of the partition member 50 and the inner peripheral surface of the case 31, becomes greater than a upward pressing force, which is generated at the contact portion between the lower end surface of the partition member 50 and the inner peripheral surface of the case 31. As a result, the partition member 50 and the sliding members 51*a*, 51*b* move downward in the direction across the rotor 40. When the partition member 50 moves, the sliding members 51*a*, 51*b* slide on the inner surface of the through part 41*a*, enabling the partition member 50 to move smoothly.

In addition, with the rotation of the rotor 40, the partition member 50 moves while expanding and shrinking in the longitudinal direction, so that both end surfaces of the partition member 50 are in constant contact with the inner surface of the case 31. By the movement, expansion and shrinkage of the partition member 50 with rotation of the rotor 40, negative pressure can be generated within the chamber communicating with the suction inlet 31*a*, and ink present in the chamber communicating with the exhaust outlet 31*b* can be ejected from the exhaust outlet 31*b*.

In this way, when the rotor 40 is rotated with the peripheral surface of the rotating part 41 of the rotor 40, except for the cut portion 42, in contact with the inner surface of the case 31 such as to close the ink path from the suction inlet 31*a* to the exhaust outlet 31*b*, ink in the ink tank 20 is forcibly sucked from the suction inlet 31*a* into the pump 30 and ejected from the exhaust outlet 31*b*. Thereby ink can be forcibly sent to the inkjet head 2 via the tube 13 connected to the exhaust outlet 31*b*. Therefore, bubbles initially present in ink or bubbles trapped in ink from the tube 13 connected to the exhaust outlet 31*b* in the pump 30 can be purged.

By a force of the pump 30 that sucks ink from the ink tank 20 while ejecting it toward the inkjet head 2, bubbles trapped in ink are sent toward the inkjet head 2 with ink, such that bubbles are eliminated from the ink passage from the inkjet head 2 to the ink tank 20.

When the rotor 40 is in a position that makes contact with the specified position of the wall surface defining the hollow 32 in the case 31, the suction inlet 31*a* and the exhaust outlet 31*b* are always maintained out of contact with each other even when the rotor 40 is rotated. In other words, the resistance in the flow passage between the suction inlet 31*a* and the exhaust outlet 31*b* is maintained high. Thus, during purging, there is no reduction in the performance of the pump 30 to force ink to flow.

The above pump has comparatively few constitutional parts in number, and is thus structured simply, so that it can be easily manufactured in a larger size or smaller size and it is suitable to make up a pump for sending a small amount of fluid by pressure. Thus, the pump is extremely suitable as a pump for sending ink in inkjet printers.

Figure 5B:
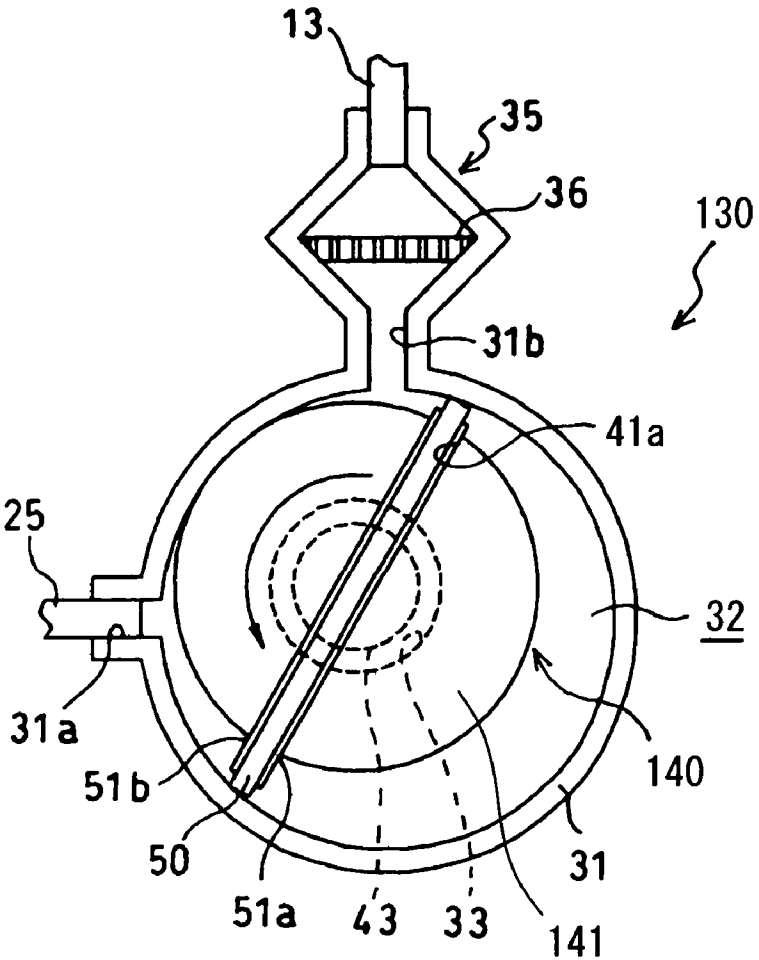
FIGS. 5A and 5B show a rotation transition of a rotor in a pump, which is a first modification of the pump shown in FIG. 4, during purging.
Figure 5A:
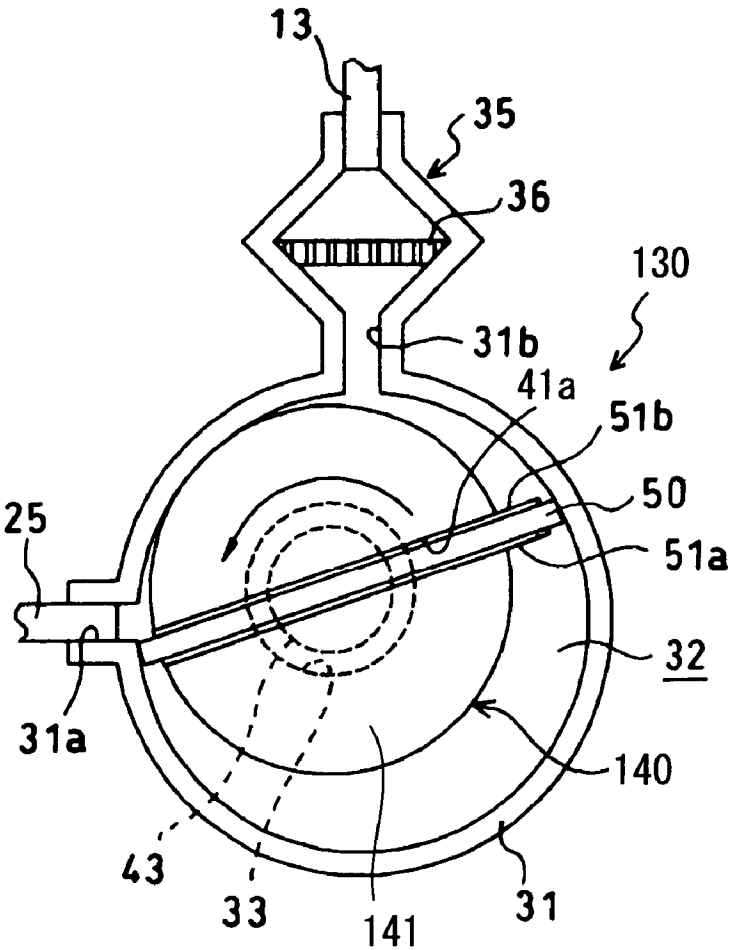

Furthermore, to improve the performance of the pump 30 to force ink to flow during purging, that is, to improve the pump performance, for example, a pump 60 may be applied to the inkjet printer 1 as a modification of the pump 30. FIGS. 5A and 5B show operational states of a first modification of the pump 30 according to the embodiment, in other words, a transition where a rotor 140 of a pump 130 is rotated during purging. In the first modification, the inkjet printer 1 has substantially the same structures except for the pump 130. The pump 130 is designed for purging only. Thus, the inkjet printer 1 is structured such that ink is supplied from the ink tank 20 to the inkjet head 2 via an ink passage 19 (indicated by chain lines in FIG. 3) formed to detour the pump 130 while printing is made onto a sheet at the inkjet head 2. Both ends of the ink passage are provided with respective valves (not shown), which are structured to close when the pump 130 is in operation and open when the pump 130 is not in operation. Except for these points, the structure of the inkjet printer 1 including the pump 130 is substantially the same as that in the embodiment, and thus the description thereof is omitted for simplicity. As to the structure of the pump 130 in the first modification, the same parts as those of the pump 30 of the embodiment are designated by similar numerals and not described again.

The pump 130, which is the modification shown in FIGS. 5A and 5B, includes the case 31 having the suction inlet 31*a*, the exhaust outlet 31*b* and the opening 33 as is the case with the pump 30. A rotor 140 is provided in the hollow 32 in the case 31 such as to be rotatable at a fixed position, similarly to the above-mentioned pump 30, however, the cut portion 42 is not formed on the peripheral surface of a rotating part 141 of the rotor 140. This is the different point from the pump 30. Besides the missing cut portion 42, the rotary shaft 43, the through part 41*a*, the sliding members 51*a*, 51*b*, the partition member 50, the filter storing portion 35 connected to the exhaust outlet 31*b*, and the hollow needle 25 directly coupled to the suction inlet 31*a*, which are related to the rotor 140, are the same as those as described above and designated by similar numerals.

The rotor 140 of the pump 130 is disposed at a position such that the peripheral surface of the rotating part 141 makes contact with the specified position on the inner peripheral surface of the case 31. Even when the rotor 140 is rotated, the peripheral surface of the rotating part 141 of the rotor 140 is always in contact with the inner peripheral surface of the case 31. Thus, as shown in FIG. 5A, the suction inlet 31*a* and the exhaust outlet 31*b* formed at the case 31 are present in different chambers of three chambers in the hollow 32 partitioned by the case 31, the rotor 140, and the partition member 50.

When the rotor 140 of the pump 130 is rotated, the surface contact between the rotating part 141 of the rotor 140 with the case 31 does not become intermittent because the cut portion 42 is not formed on the peripheral surface of the rotating part 141. In other words, as a clearance for communication between the suction inlet 31*a* and the exhaust outlet 31*b* is not formed, the pump performance that draws in ink within the hollow 32 via the suction inlet 31*a* and ejects it from the hollow 32 via the exhaust outlet 31*b* is increased.

The following will describe the operation of the pump 130 during purging at the inkjet head 2. During printing, the rotor 140 of the pump 130 is stopped and ink is supplied from the ink tank 20 to the inkjet head 2 via the ink passage 19 shown in FIG. 3 as described above.

The pump 130 can forcibly send ink only with rotation of the rotor 140. Namely, when the rotor 140 is rotated in a direction of an arrow indicated in FIG. 5A, the chamber communicating with the suction inlet 31*a* expands as shown in FIG. 5B, and a negative pressure is generated in the chamber. Thereby ink is sucked from the ink tank 20. On the other hand, the chamber communicating with the exhaust outlet 31*b* shrinks with a rotation of the rotor 140, and ink present in the chamber is forcibly sent from the exhaust outlet 31*b* to the inkjet head 2. The movements of the partition member 50 and the sliding members 51*a*, 51*b*, which are disposed in the through part 41*a*, accompanied with the rotation of the rotor 140, are the same as those accompanied with the rotation of the rotor 40 of the pump 30 described above.

The chamber communicating with the suction inlet 31*a* and the chamber communicating with the exhaust outlet 31*b* are always closed because the peripheral surface of the rotating part 141 of the rotor 140 is in contact with the specified position on the wall surface defining the hollow 32 in the case 31. Even when the rotor 140 is continuously rotated, the suction inlet 31*a* and the exhaust outlet 31*b* are constantly maintained out of communication with each other. Thus, the performance of the pump 130 can be increased more than that of the above-described pump 30 without degradation of the sending ability of the pump 130 during purging.

A second modification of a pump included in the inkjet printer 1 according to the embodiment will be described with reference to FIGS. 6A, 6B, and 7A to 7C. In the following, the inkjet printer 1 for the second modification has substantially the same structure as those of the inkjet printer 1 using the pump 30 except for a pump 230, thus the description thereof is omitted for simplicity. As to the structure of the pump 230 in the second modification, parts equivalent to those in the pump 30 are designated by similar numerals and not described again.

Figure 6B:
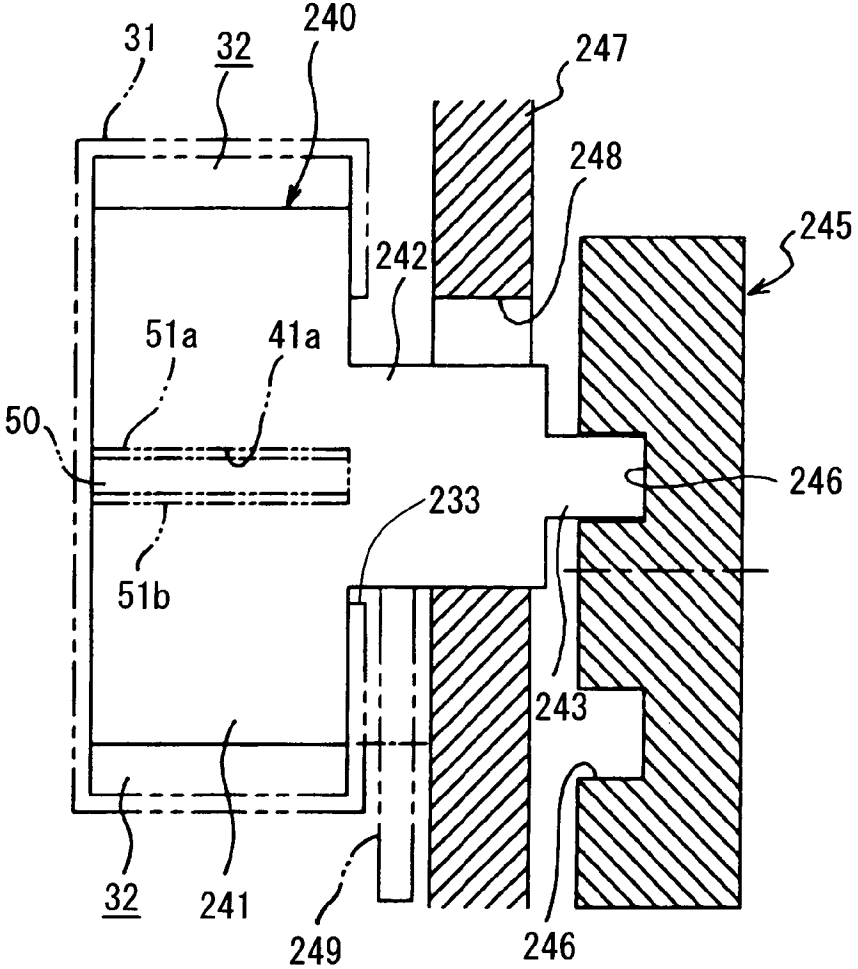
FIG. 6B is a sectional view along the line VI-VI' of FIG. 6A.
Figure 6A:
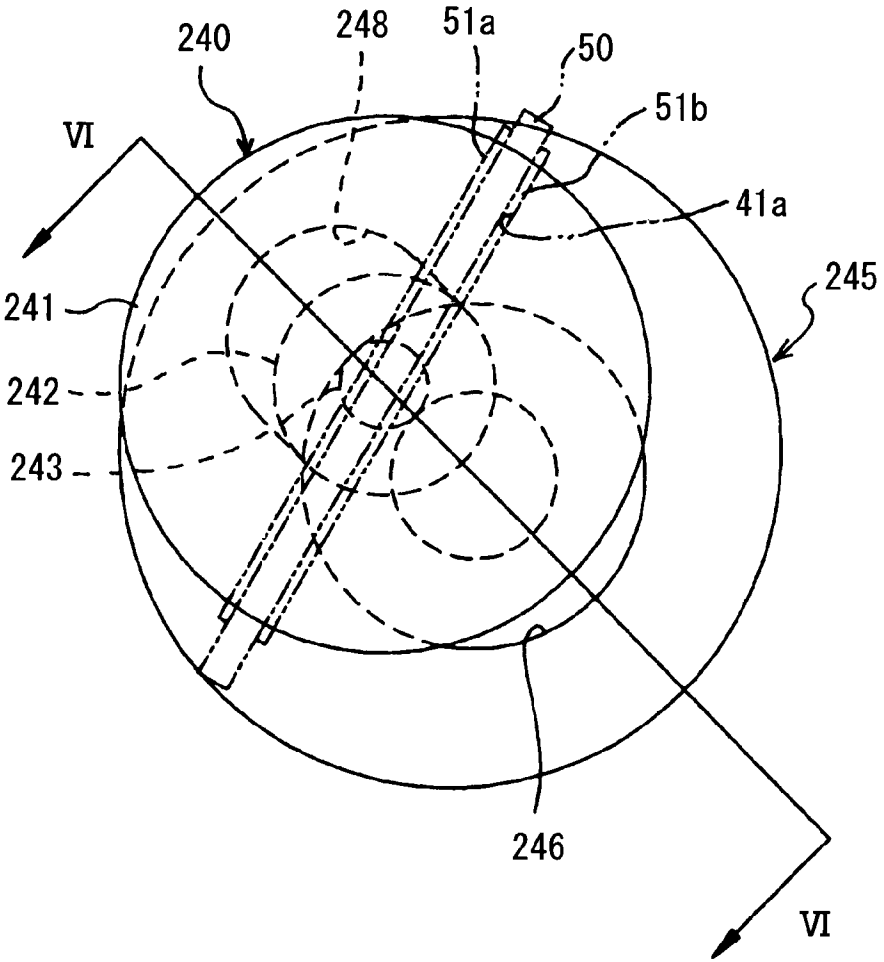
FIG. 6A is a schematic side view of a rotor of a pump, which is a second modification of the invention.

The case 31 of the pump 230 of the second modification includes a rotor 240 rotatably therein. As shown in FIGS. 6A and 6B, the rotor 240 is comprised of a rotating part 241 that rotates in the case 31 and a shaft 242 that transmits rotation force to the rotating part 241. An opening 233 through which the shaft 242 passes is formed on one end surface of the case 31. The rotating part 241 has a cylindrical shape and a thickness such that both end surfaces of the rotating part 241 with respect to its axial direction are in contact with end wall surfaces defining the hollow 32 (both inner end surfaces of the case 31). The through part 41*a* is formed on the peripheral surface thereof in a diameter direction of the rotating part 241.

As shown in FIG. 6B, the shaft 242 is cylindrically formed so as to protrude from one end surface of the rotating part 241. The shaft 242 has a cylindrical protrusion 243 on the end surface opposite to a side where the rotating part 241 is provided. A grooved cam 245 is disposed on the right side of the protrusion 243 in FIG. 6B. The protrusion 243 is in contact with a cam groove 246 formed on the end surface of the grooved cam 245, which faces the rotor 240.

The grooved cam 245 has a disk-like shape, and the cam groove 246 is formed on the end surface facing the rotor 240 such that it is circularly continuous. The center of the cam groove 246 is eccentric from the center of the cam 245 in a lower-right direction in FIG. 6A. Thus, the center of the cam groove 246 is moved in a circle as the grooved cam 245 rotates.

A guide member 247 and a gear 249 are disposed between the rotating part 241 of the rotor 240 and the grooved cam 245. The guide member 247 has an oval opening 248 formed through its thickness. The shaft 242 passes through the opening 248. Thus, when the grooved cam 245 rotates, the cam groove 246 forces the protrusion 243 of the shaft 242 to move, and the rotating part 241 is also moved via the shaft 242. Since the shaft 242 passes through the opening 248 of the guide member 247, such a movement is made in a direction along the opening 248. The movement of the rotor 240 caused by a rotation of the grooved cam 245 is restricted at the opening 248 of the guide member 247 when the peripheral surface of the rotating part 241 of the rotor 240 is in contact with an upper left portion (a specified position), shown in FIG. 7B, of the inner surface of the case 31 (a wall surface defining the hollow 32 in the case 31).

The gear 249 is disposed in a position such that its side surface is maintained in constant contact with the peripheral surface of the shaft 242 partially, as shown in FIG. 6B. Thus, the gear 249 is rotated by a drive device (not shown), a rotational force is applied to the shaft 242 in the direction opposite to a rotational direction of the gear 249, and the rotating part 241 is also rotated.

The partition member 50 and the two sliding members 51*a*, 51*b* that sandwich the partition member 50 therebetween are disposed in the through part 41*a* of the rotating part 241 across the rotating part 241 on the center thereof, similarly to the above embodiment.

Figure 7A:
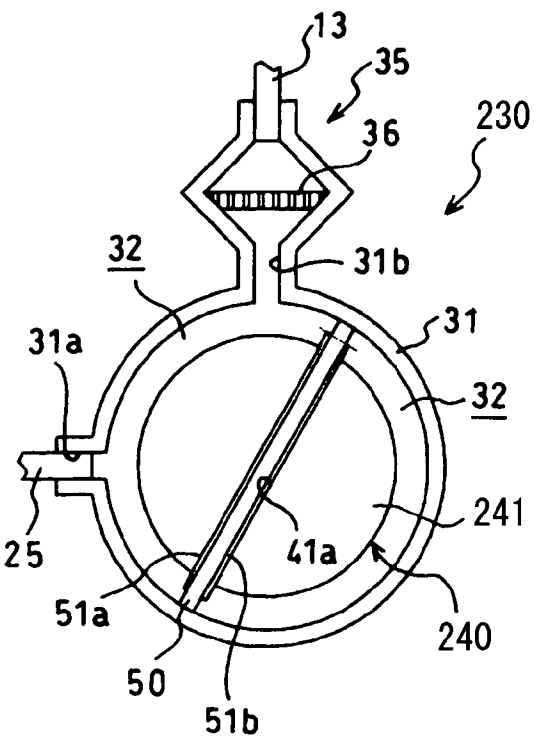
FIG. 7A shows a state of the pump according to the second modification during printing.
Figure 7B:
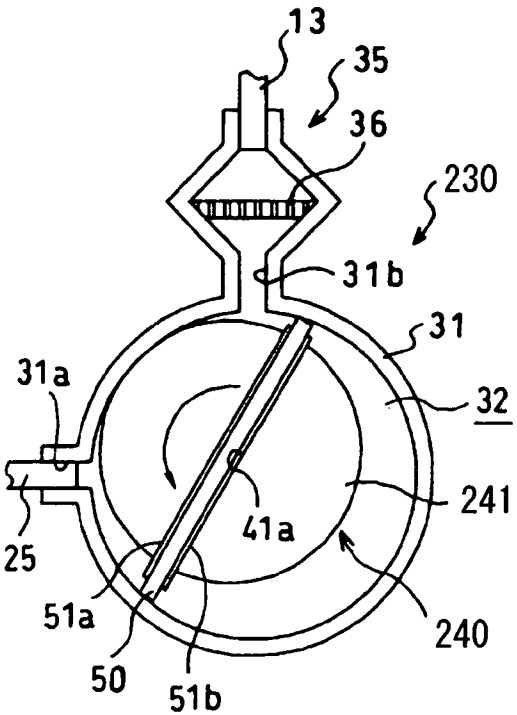
FIGS. 7B and 7C show a rotation transition of a rotor in the pump during purging.

The partition member 50 shown in FIG. 7A has a rectangular plate-like shape in a plane, and a length such that both end surfaces of the partition member 50 with respect to its longitudinal direction (with respect to a direction across the rotating part 241) are in contact with the inner surface of the case 31. The hollow 32 in the case 31 is always partitioned into two chambers by the partition member 50. Of the partitioned chambers, one chamber where the suction inlet 31*a* is communicated with the exhaust outlet 31*b* provides an ink passage through which ink is supplied from the ink tank 20 toward the inkjet head 2, as shown in FIG. 7A. The chamber where the suction inlet 31*a* is communicated with the exhaust outlet 31*b* is further partitioned into two chambers by a half turn of the grooved cam 245 where the rotating part 241 of the rotor 240 moves in contact with the inner surface of the case 31, as shown in FIG. 7B, via the shaft 242 that moves along the opening 248 of the guide member 247. Accordingly, resistance in the flow passage between the suction inlet 31*a* and the exhaust outlet 31*b* in this state becomes higher than that in a state shown in FIG. 7A.

The following will describe how ink is supplied to the inkjet head 2 during printing in the inkjet printer 1. The pump 230 forms a part of the ink passage between the inkjet head 2 and the ink tank 20, as is the case of the pump 30. During printing onto a sheet, in the pump 230, the rotor 240 is disposed at a substantially center of the hollow 32 in the case 31 and stopped as shown in FIG. 7A such that the inkjet head 2 can draw in ink. That is, the rotor 240 is stopped at a position where the hollow 32 in the case 31 is partitioned by the partition member 50 disposed in the through part 41*a* of the rotor 240 such as to form the chamber where the suction inlet 31*a* and the exhaust outlet 31*b* are communicated.

While the suction inlet 31*a* and the exhaust outlet 31*b* are in communication with each other, the ink passage from the inkjet head 2 to the ink tank 20 is provided, so that ink is supplied to the inkjet head 2. In other words, the resistance in the ink passage from the suction inlet 31 to the exhaust outlet 31*b* in the case 31 of the pump 230 becomes low, and during printing, an adequate amount of ink is supplied from the ink tank 20 via the pump 230 in response to an ejection of ink to the inkjet head 2.

The following will describe the pump operation in the second modification during purging at the inkjet printer 1. In the pump 230 during purging, the rotor 240 is moved from the position shown in FIG. 7A to the position shown in FIG. 7B. In other words, by a half turn of the grooved cam 245, which is in a state in that the center of the rotor 240 is located in substantially the center of the hollow 32 in the case 31, the protrusion 243 of the shaft 242 of the rotor 240 moves along the cam groove 246, the shaft 242 of the rotor 240 moves along the opening 248 of the guide member 247, and the peripheral surface of the rotating part 241 of the rotor 240 make contact with the inner surface of the case 31 at the specified position as shown in FIG. 7B. Thus, in the hollow 32 in the case 31 partitioned by the partition member 50 disposed in the through part 41*a* of the rotor 240, the flow passage from the suction inlet 31*a* to the exhaust outlet 31*b* is closed.

Figure 7C:
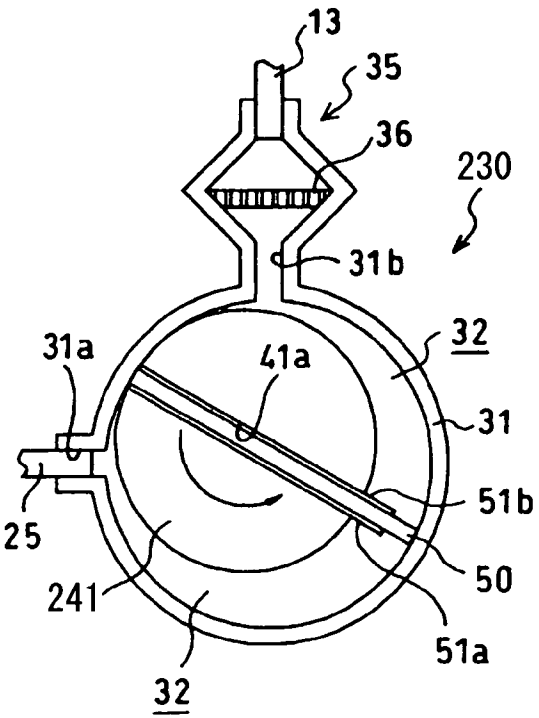

The gear 249 is then rotated by the drive device (not shown) to rotate the rotor 240 in a direction of an arrow shown in FIG. 7B, counterclockwise. As the rotor 240 is rotated in the direction of the arrow shown in FIG. 7B, the chamber communicating with the suction inlet 31*a*, which is partitioned by rotating the rotor 240, expands as shown in FIG. 7C, and negative pressure is generated in the chamber and ink is sucked from the ink tank 20. On the other hand, the chamber communicating with the exhaust outlet 31*b* shrinks with a rotation of the rotor 240, and ink present in the chamber is forced out through the exhaust outlet 31*b* to the inkjet head 2.

The partition member 50 and the sliding members 51*a*, 51*b*, which are disposed in the through part 41*a* of the rotor 240, slide on the inner surfaces of the through part 41*a* from the state shown in FIG. 7B with a rotation of the rotor 240, and move in the direction across the rotor 240 as shown in FIG. 7C. That is, by rotating the rotor 240, on the partition member 50 shown in FIG. 7B with respect to the direction across the rotor 240, a downward pressing force, which is generated at the contact portion between the upper end surface of the partition member 50 and the inner surface of the case 31, becomes greater than an upward pressing force, which is generated at the contact portion between the lower end surface of the partition member 50 and the inner surface of the case 31. Thus, the partition member 50 moves downward with respect to the direction across the rotor 240. When the partition member 50 moves, the sliding members 51*a*, 51*b* slide on the inner surface of the through part 41*a*, enabling the partition member 50 to move smoothly.

Further, as the partition member 50 moves while expanding and shrinking in the longitudinal direction thereof by rotating the rotor 240, both end surfaces of the partition member 50 are in constant contact with the inner surface of the case 31. By the movement, expansion and shrinkage of the partition member 50 with rotation of the rotor 240, negative pressure can be generated within the chamber communicating with the suction inlet 31*a*, and ink present in the chamber communicating with the exhaust outlet 31*b* can be ejected from the exhaust outlet 31*b*.

Thus, as the chamber where the suction inlet 31*a* and the exhaust outlet 31*b* are communicated with each other is partitioned with a movement of the rotor 240, once the rotor 240 is rotated with the passage from the suction inlet 31*a* to the exhaust outlet 31*b* closed, ink in the ink tank 20 is forcibly sucked from the suction inlet 31*a* into the pump 230 and ejected from the exhaust outlet 31*b*. Thereby ink is forcibly sent toward the inkjet head 2 via the tube 13 connected to the exhaust outlet 31*b*. Therefore, bubbles initially present in ink or bubbles trapped in ink from the tube 13 connected to the exhaust outlet 31*b* in the pump 230 can be purged.

By a force of the pump 230 that sucks ink from the ink tank 20, while ejecting it toward the inkjet head 2, bubbles trapped in ink are sent toward the inkjet head 2 with ink, such that bubbles are eliminated from the ink passage from the inkjet head 2 to the ink tank 20.

When the rotor 240 is in a position making contact with the specified position of the wall surface defining the hollow 32 in the case 31, the suction inlet 31*a* and the exhaust outlet 31*b* are maintained out of communication with each other even when the rotor 240 is rotated. In other words, the resistance in the flow passage between the suction inlet 31*a* and the exhaust outlet 31*b* is maintained high. Thus, during purging, there is no reduction in the performance of the pump 230 to force ink to flow.

Figure 8A:
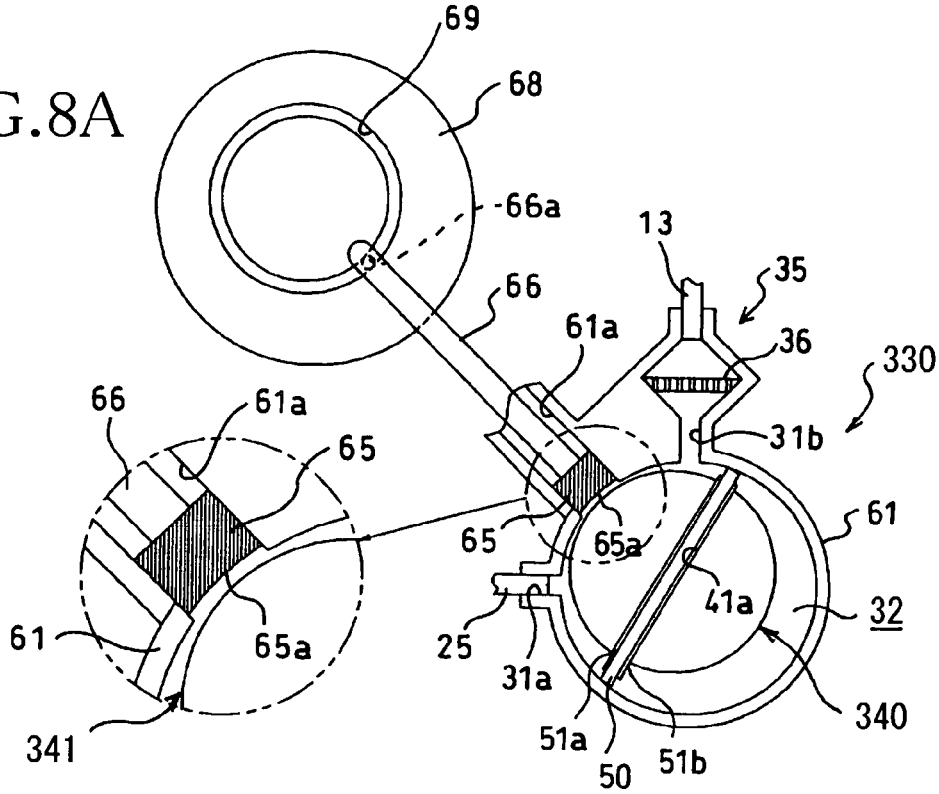
FIG. 8A shows a state of a pump according to a third modification during printing.
Figure 8B:
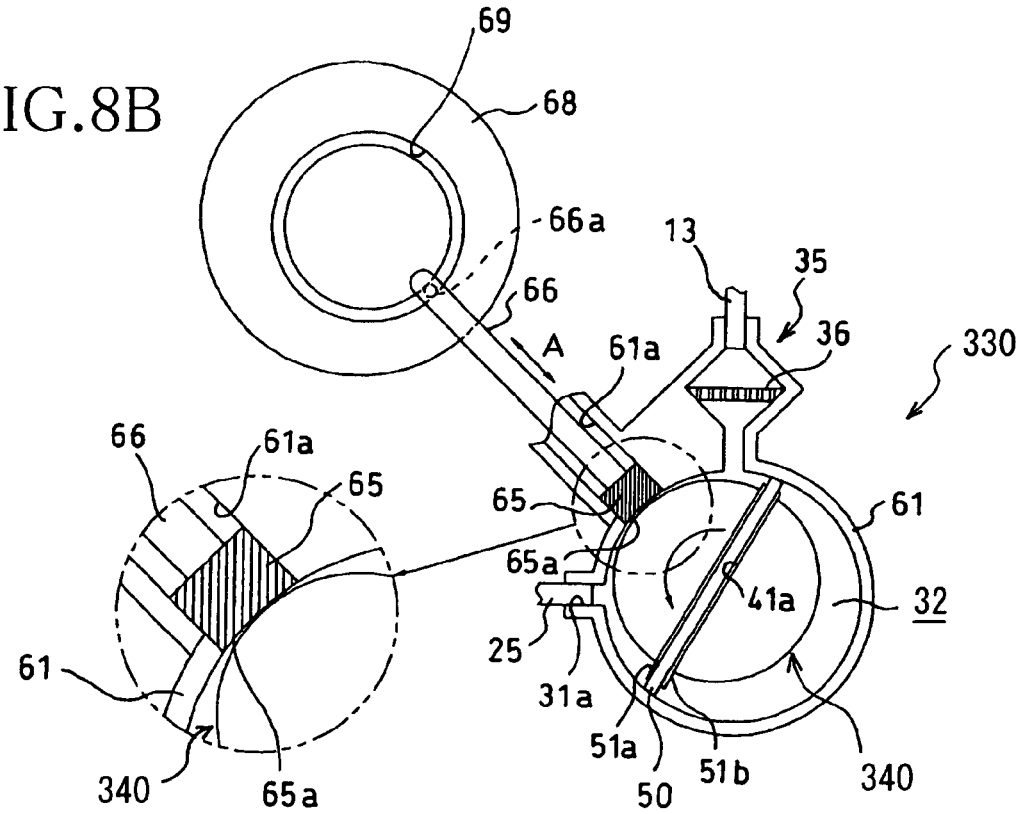
FIG. 8B shows a state of the pump during purging.

A third modification of a pump included in the inkjet printer 1 according to the embodiment will be described with reference to FIGS. 8A and 8B. FIG. 8A shows a state of a pump 330 during printing. FIG. 8B shows a state of the pump 330 during purging. In the following, as the inkjet printer 1 for the third modification has substantially the same structure as that of the inkjet printer 1 using the pump 30 except for the pump 330, thus the description thereof is omitted for simplicity. In addition, as to the structure of the pump 330 in the third modification, parts equivalent to those in the pump 30 are designated by similar numerals and thus are not described again.

The pump 330 of the third modification shown in FIGS. 8A and 8B is provided with a case 61 having the suction inlet 31*a* and the exhaust outlet 31*b* as is the case with the pump 30 described above. The hollow 32 is defined in the case 61. Of the wall surface defining the hollow 32, a part of the wall surface between the suction inlet 31*a* and the exhaust outlet 31*b* is composed of a movable wall member 65. In the case 61, a rotor 340, which is similar to that in the pump 30, is provided. The rotor 340, however, does not move as in the pump 230, and is provided rotatably at a fixed position. The through part 41*a*, the sliding members 51*a*, 51*b*, the partition member 50, the filter storing portion 35 connected to the exhaust outlet 31*b*, the hollow needle 25 directly connected to the suction inlet 31*a*, which are related to the rotor 340, are the same as those as described above and designated by the same numerals.

The rotor 340 of the pump 330 is disposed such that the peripheral surface of the rotor 340 can make contact with the movable wall member 65 when the movable wall member 65 is on the circumference of the inner surface of the case 61 as shown in FIG. 8B. This position is substantially similar to the specified position on the inner surface of the case 31, which the rotor 240 of the pump 230, the second modification, moves in contact with. The rotor 340 is rotated by a drive device (not shown) at the position. That is, the pump 330 is not provided with parts required for moving the rotor 240 in the second modification, such as the grooved cam 245 and the guide member 247.

The case 61 is provided with a through portion 61*a*, which is on the peripheral surface of the case 61 on the side where the distance between the suction inlet 31*a* and the exhaust outlet 31*b* is shorter. The through portion 61*a* guides the movable wall member 65 slidably. The case 61 has a shape similar to that of the case 31 in the pump 30 according to the embodiment except for which the through portion 61*a* is formed.

The movable wall member 65, which is guided slidably by the through portion 61*a* of the case 61, has an outer peripheral shape substantially similar to an inner peripheral shape of the through portion 61*a*, which is substantially a rectangular solid shape. The movable wall member 65 is provided with a sealing member (not shown) around an outer peripheral surface thereof. This sealing member prevents bubbles from being trapped in ink in the pump 330 in between the movable wall member 65 and the through portion 61*a*, and further prevents ink from leaking out of the pump 330. An end surface 65*a* of the movable wall member 65, which faces the rotor 340, has a spherical shape similar to that of the inner surface of the case 61 (the wall surface defining the hollow 32 in the case 61), and constitutes a part of the inner surface of the case 61.

An arm 66 is connected to other end surface of the movable wall member 65, which is the opposite side of the end surface 65*a*. A grooved cam 68 is connected to an end of the arm 66 that is the opposite side to which the movable wall member 65 is connected. The grooved cam 68 includes, on a surface facing the arm 66, a cam groove 69 whose center is eccentric as is the case with the grooved cam 245 in the second modification. Thus, as the grooved cam 68 is rotated, the center of the cam groove 69 moves in a circle.

A protrusion 66*a* is formed on an end portion of the arm 66, which faces toward the grooved cam 68. The protrusion 66*a* protrudes toward the cam groove 69 and fits in the cam groove 69. Thus, as the grooved cam 68 is rotated, the protrusion 66*a* is moved along the cam groove 69, so that the arm 66 moves in a direction A as shown in FIG. 8B and thus the movable wall member 65 also moves similarly. By moving the movable wall member 65 in this way, the movable wall member 65 can be moved to a position making contact with the rotor 340 of the pump 330 and a position out of contact with the rotor 340. Thereby changing the flow resistance in the chamber where the suction inlet 31*a* and the exhaust outlet 31*b* are communicated with each other of the hollow 32 in the case 61, which is partitioned by the partition member 50 disposed in the through part 41*a* of the rotor 340.

The following will describe the operation of the pump 330 during printing and purging at the inkjet head 2. As described above, while printing is made on a sheet at the inkjet head 2, ink is supplied from the ink tank 20 as the inkjet head 2 sucks ink, so that the movable wall member 65 of the pump 330 reaches a state where it is placed in isolation at the position out of contact with the rotor 340. That is, by rotating the grooved cam 68, the protrusion 66*a* of the arm 66 moves along the cam groove 69, and thus the movable wall member 65 also moves along the through part 61*a* via the arm 66. When the movable member 65 is isolated from the peripheral surface of the rotor 340, the grooved cam 68 is stopped, and the suction inlet 31*a* and the exhaust outlet 31*b* are brought into communication with each other. At this time, the rotor 340 of the pump 330 is stopped such that the partition member 50 is in the position to form the chamber where the suction inlet 31*a* and the exhaust outlet 31*b* are in communication with each other.

The movable wall member 65 is separated from the rotor 340 so that the suction inlet 31*a* and the exhaust outlet 31*b* are communicated with each other. As a result, the fluid resistance in the passage from the suction inlet 31*a* to the exhaust outlet 31*b* becomes low, and ink is spontaneously supplied as required from the ink tank 20 to the inkjet head 2 via the pump 330 in accordance with an ejection of ink from the inkjet head 2, as is the case with the pump 30 according to the embodiment.

An operation of the pump 330 during purging will be described. The movable wall member 65 is moved from the position shown in FIG. 8A to the position shown in FIG. 8B. In other words, when the grooved cam 68, which is in a state where the movable wall member 65 is separated from the rotor 340, is rotated a half-turn, the protrusion 66*a* of the arm 66 is moved along the cam groove 69, the arm 66 is moved to the rotor 340, and the end surface 65*a* of the movable wall member 65 makes contact with the peripheral surface of the rotor 340. In this way, as is the case with the pump 30 described above, the passage from the suction inlet 31*a* to the exhaust outlet 31*b*, which is formed in the hollow 32 partitioned by the partition member 50 disposed in the through part 41*s* of the rotor 340, is closed.

The rotor 340 is rotated in a direction of an arrow in FIG. 8B (counterclockwise) by the drive device (not shown), as is the case with the pump 30 described above. The chamber communicating with the suction inlet 31*a* expands to suck ink into the chamber from the ink tank 20, and the chamber communicating with the exhaust outlet 31*b* shrinks to forcibly eject ink present in the chamber from the exhaust outlet 31*b* to send it to the inkjet head 2. The movements of the partition member 50 and the sliding members 51*a*, 51*b* accompanied with a rotation of the rotor 340 are the same as those accompanied with a rotation of the rotor 40 of the above-mentioned pump 30.

The chamber where the suction inlet 31*a* and the exhaust outlet 31*b* are communicated with each other is partitioned in accordance with the movement of the movable wall member 65, so that the passage from the suction inlet 31*a* to the exhaust outlet 31*b* is closed. As the rotor 340 is rotated with the passage closed, the pump 330 can forcibly send ink to the inkjet head 2, as is the case with the pump 30. Therefore, as is the case with the pump 30 described above, bubbles initially present in ink or bubbles trapped in ink from the tube 13 connected to the exhaust outlet 31*b* in the pump 330 can be purged with ink, so that it is possible to eliminate the bubbles from ink. In addition, as is the case with the pump 30, even when the rotor 340 is rotated, the suction inlet 31*a* and the exhaust outlet 31*b* are always maintained out of communication with each other. In other words, the resistance in the passage between the suction inlet 31*a* and the exhaust outlet 31*b* is maintained extremely high, so that, during purging, there is no reduction in the performance of the pump 330 to force ink to flow.

Figure 9C:
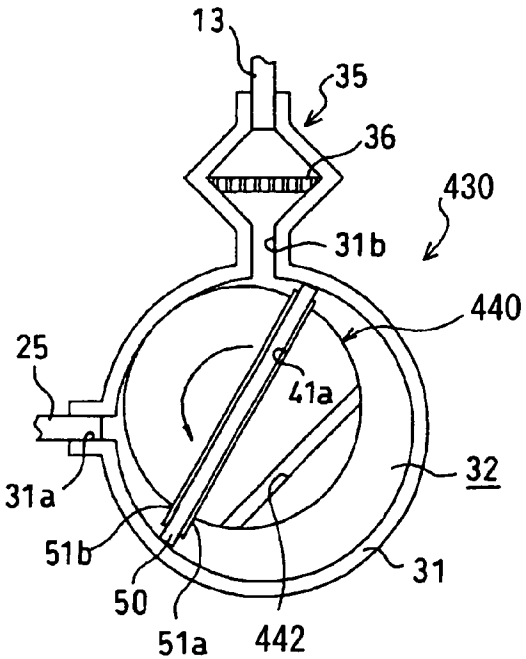
FIGS. 9B and 9C show a rotation transition of a rotor in the pump during purging.
Figure 9B:
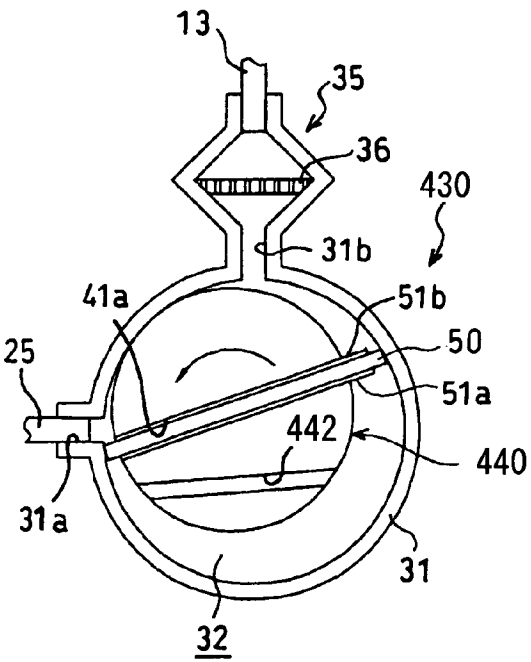
Figure 9A:
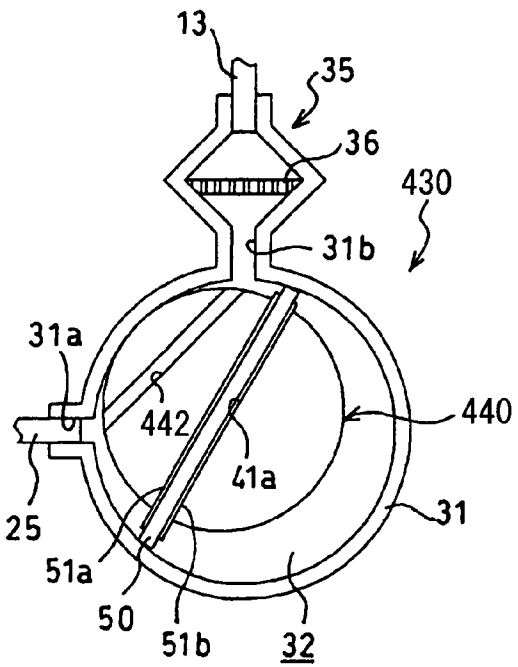
FIG. 9A shows a state of a pump according to a fourth modification during printing.

A fourth modification of a pump included in the inkjet head printer 1 according to the embodiment will be described with reference to FIGS. 9A to 9C. FIG. 9A shows a state of a pump 430 during printing, and FIGS. 9B and 9C show a transition where a rotor 440 of the pump 430 is rotated during purging. In the following, as the inkjet printer 1 for the fourth modification has substantially the same structure as that of the inkjet printer 1 using the pump 30 except for the pump 430, thus the description thereof is omitted for simplicity. In addition, as to the structure of the pump 430 in the fourth modification, parts equivalent to those in the pump 30 are designated by similar numerals and thus are not described again.

The pump 430 shown in FIG. 9A is substantially the same as the pump 30 according to the above-mentioned embodiment, and is provided with a tunnel 442 that connects two places on the peripheral surface of the rotor 440, instead of the cut portion 42 formed in the rotor 41 of the pump 30.

As shown in FIG. 9A, the rotor 440 of the pump 430 is provided in the case 31 such as to be rotatable at a fixed position similar to that of the rotor 40 in the embodiment, and a part of the peripheral surface of the rotor 440 always making contact with the inner surface of the case 31. The tunnel 442 is cut through in the direction across the rotor 440 between the through part 41*a* and a contact between the peripheral surface of the rotor 440 and the inner surface of the case 31 such that the tunnel 442 should not overlap the through part 41*a*.

When the tunnel 442 of the rotor 440 is placed in the chamber where the suction inlet 31*a* and the exhaust outlet 31*b* exist in the hollow 32 partitioned by the partition member 50 as shown in FIG. 9A, the suction inlet 31*a* and the exhaust outlet 31*b* are brought in communication with each other. When the rotor 440 is rotated so that the peripheral surface of the rotor 440 can make contact with the inner surface of the case 31, as shown in FIG. 9B, on a side where there is not the tunnel 442 opposing a side where the tunnel 442 is formed across the through part 41*a*, the ink passage from the suction inlet 31*a* to the exhaust outlet 31*b* can be closed. Thus, the pump 430 that changes the fluid resistance in the ink passage from the suction inlet 31*a* to the exhaust outlet 31*b* by the rotation of the rotor 440 can be easily manufactured by only providing the tunnel 442 that connects the two places on the peripheral surface of the rotor 440.

The following will describe the operation of the pump 430 during printing at the inkjet head 2. While printing is made on a sheet at the inkjet head 2, the inkjet head 2 sucks ink, so that ink is supplied from the ink tank 20, as described above. As shown in FIG. 9A, the rotor 440 is stopped such that the tunnel 442 is placed in the chamber where the suction inlet 31*a* and the exhaust outlet 31*b* exist in the hollow 32 partitioned by the partition member 50.

The tunnel 442 of the rotor 440 allows communication between the suction inlet 31*a* and the exhaust outlet 31*b*, thereby providing the ink passage in the pump 430. In addition, the resistance in the ink passage from the suction inlet 31*a* to the exhaust outlet 31*b* becomes low, and ink is spontaneously supplied as required from the ink tank 20 to the inkjet head 2 via the pump 430 in accordance with an ejection of ink from the inkjet head 2, as is the case with the pump 30 according to the embodiment.

An operation of the pump 430 during purging will be described. The pump 430 can force ink to flow by only rotating the rotor 440 counterclockwise from the state shown in FIG. 9A. That is, as shown in FIG. 9B, when the rotor 440 is rotated counterclockwise, the peripheral surface of the rotor 440 is in contact with the inner surface of the case 31 on the side where there is not the tunnel 442 opposing the side where the tunnel 442 is formed across the through part 41*a*, and the passage from the suction inlet 31*a* to the exhaust outlet 31*b* is closed. With this state, when the rotor 440 is rotated counterclockwise as shown in FIG. 9C, the chamber communicating with the suction inlet 31*a* expands and ink is sucked in the chamber from the ink tank 20, whereas the chamber communicating with the exhaust outlet 31*b* shrinks and ink present in the chamber is forcibly ejected from the exhaust outlet 31*b* and conveyed to the inkjet head 2. The movements of the partition member 50 and the sliding members 51*a*, 51 *b* accompanied with a rotation of the rotor 440 are the same as those accompanied with a rotation of the rotor 40 of the above-mentioned pump 30.

Thus, when the rotor 440 is rotated with the peripheral surface of the rotor 440 brought in contact with the inner surface of the case 31 on the side where there is not the tunnel 442 opposing the side where the tunnel 442 is formed across the through part 41*a*, such that the ink passage from the suction inlet 31*a* to the exhaust outlet 31*b* may remain closed, ink can be forcibly sent to the inkjet head 2 as is the case with the pump 30. Accordingly, as in the case of the pump 30, bubbles initially present in ink or bubbles trapped in ink from the tube 13 connected to the exhaust outlet 31*b* in the pump 430 can be purged with ink.

As described above, while the ink passage from the suction inlet 31*a* to the exhaust outlet 31*b* is closed in the pump 30, 130, 230, 330, 430, continuous rotation of the rotor 40, 140, 240, 340, 440 enables ink to forcibly supply from the ink tank 20 to the inkjet head 2 even without printing, and bubbles remaining in the inkjet head 2 can be also purged with ink. In addition, both printing and purging at the inkjet head 2 can be performed easily by making the fluid resistance between the suction inlet 31*a* and the exhaust outlet 31*b* variable. The pump performance that sends ink toward the inkjet head 2 and an amount of ink to be conveyed toward the inkjet head 2 can be adjusted by controlling the number of rotations of the rotor 40, 140, 240, 340, 430.

In contrast to the use of a flexible tube, a space in the ink tank 20 and an ink passage in the inkjet head 2 are connected at the hollow 32 in the pump 30, 230, 330, 430 without segmentation, thereby preventing malfunctions regarding ink supply to the inkjet head 2 caused by pump trouble. As there is no need to dispose a flexible tube in the pump 30, 230, 330, 430, a barrier effect to prevent bubbles in the pump 30, 230, 330, 430 can be improved. As only the hollow needle 25 is interposed between the ink tank 20 and the pump 30, 230, 330, 430, bubbles are seldom trapped in ink between the ink tank 20 and the pump 30, 230, 330, 430.

While the invention has been described with reference to the preferred embodiment, it is to be understood that the invention is not restricted to the particular forms shown in the foregoing embodiment. Various modifications and alternations can be made thereto without departing from the scope of the invention. For example, in the pump operation during purging, while the rotor 40, 240, 340, 440 is rotated, the peripheral surface of the rotor 40, 240, 340, 440 of the pump 30, 230, 330, 430 and the inner surface of the case 31, 61 (the wall surface defining the space in the case) may be always out of contact with each other so as to have a slight clearance therebetween. That is, in the chamber where the suction inlet 31*a* and the exhaust outlet 31*b* are present, of the two chambers that are partitioned by the partition member 50 in the hollow 32 in the case 31, 61 of the pump 30, 230, 330, 440, the peripheral surface of the rotor 40, 240, 340, 440 may be brought as close to the inner surface of the case 31, 61 of the pump 30, 230, 330, 440 as possible, thereby making the fluid resistance from the suction inlet 31*a* to the exhaust outlet 31*b* go high. When the rotor 40, 240, 340, 440 is rotated in this status, it is possible to suck ink through the suction inlet while ejecting ink through the exhaust outlet.

In the above embodiment and modifications, the rotor 40 of the pump 30 and the movable wall member 65 of the pump 330 are moved through the use of a grooved cam. However, they can be moved by a cylinder.

The filter storing portion 35 may not be provided. In addition, there is no need to provide the sliding members 51*a*, 51*b* which put therebetween the partition member 50 disposed in the through part 41*a* of the rotor 40, 240, 340, and 440. The partition member 50 may be formed of several sheets in stack. Furthermore, a coating agent may be applied to the surface of the partition member 50 which contacts the inner surface of the through part 41*a*, as a sliding agent. The invention may be applicable to not only line-type inkjet printers but also serial-type inkjet printers.

The invention can be applied to not only inkjet printers but also anything required pump function that draws in fluid from a suction inlet and ejects the fluid from an exhaust outlet. Further, the fluid sucked and ejected from the pump is not limited to ink, and can be a different fluid or air.

The partition member 5 may be constructed of not only EPDM but also a different synthetic rubber such as SBR (styrene butadiene rubber), NBR (nitrile-butadiene rubber), CR (chloroprene rubber), and fluorine rubber. In addition, the sliding members 51*a*, 51*b* may be constructed of not only acetal polyoxymethylene (POM) resin but also other engineering resins such as poly-carbonate (PC) resin, polypropylene (PP) resin, and polyethylene (PE) resin.

The partition member 50 may be formed in the following shape. In the following description, it is assumed that the basic structures of a pump are those applied to the pump 30 of the embodiment. Thus, the parts except for the partition member 50 are designated by the same numerals as used in the pump 30 of the embodiment, and not described again.

As shown in FIGS. 11A-11E, the partition member 50 is a plate-like member of which edge portions are cut at a bevel facing in the opposite direction to a rotational direction R (FIG. 11E) of the partition member 50, so that slopes (50*a*, 50*b*, 50*c* of FIG. 11) are formed each having approximately 30 degrees with respect to the front and back surfaces of the partition member 50, and thereby the edge portions are formed thinner toward the edges. The very edges of the partition member 50 are rounded. The partition member 50 is disposed at such a position as to pass through the inside of the rotor 40 with its front and back surfaces orientated parallel to the rotational axis of the rotor 40. The partition member 50 is maintained in the rotor 40 such as to be slidable in a direction perpendicular to the rotational axis of the rotor 40 and along the front and back surfaces of the partition member 50. The partition member 50 makes contact with the inner surface of the case 31 at its edge portions to partition the hollow 32 into two.

Figure 10:
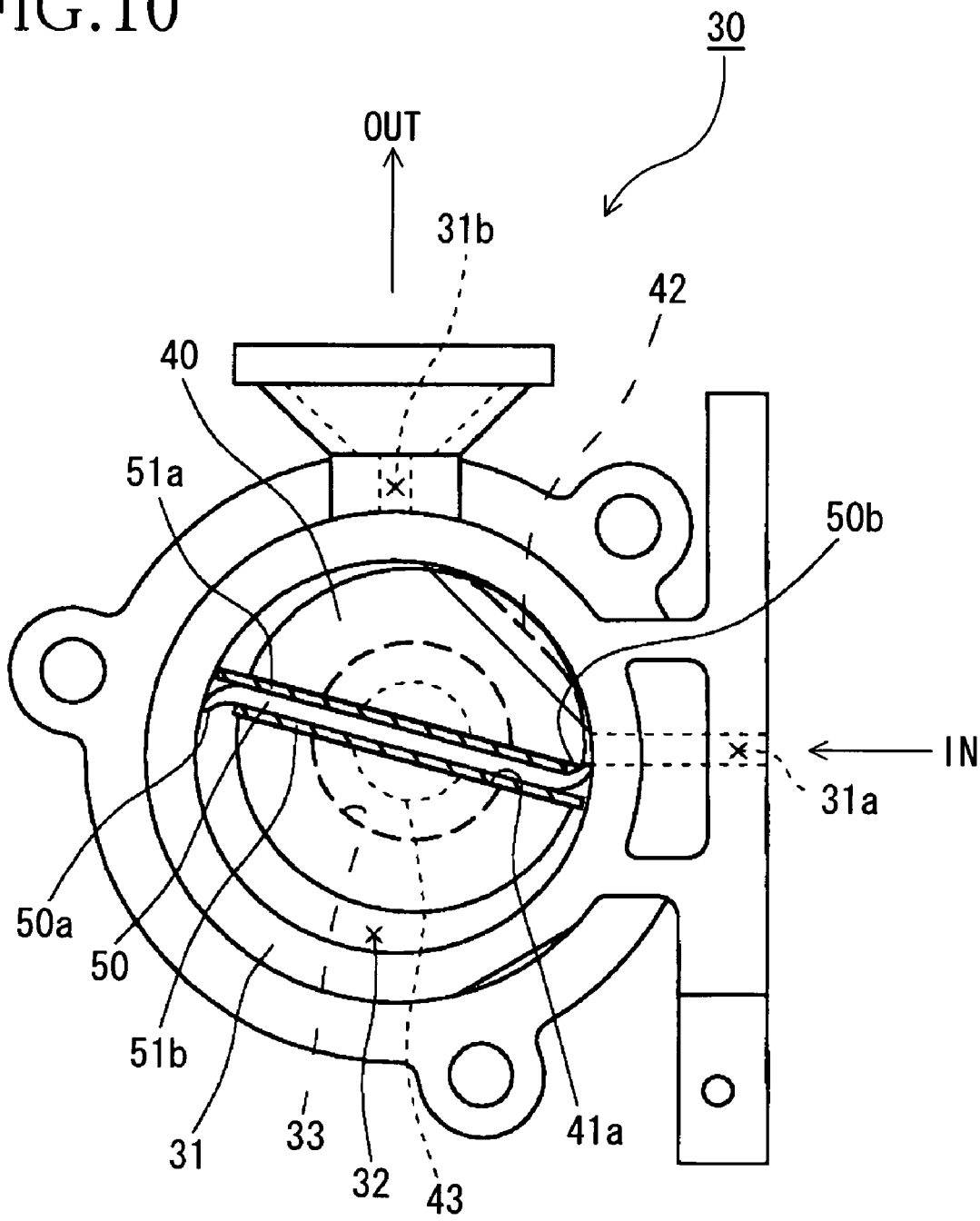
FIG. 10 is a schematic diagram showing an internal structure of a pump.
Figure 11A:
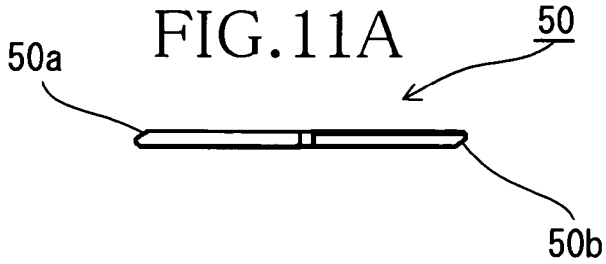
FIG. 11A is a plan view of a partition member.
Figure 11B:
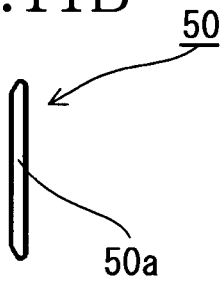
FIG. 11B is a left side view of the partition member.
Figure 11C:
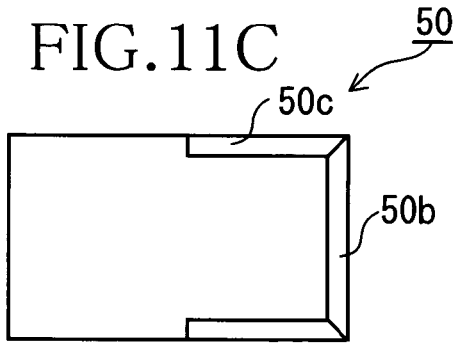
FIG. 11C is a front view of the partition member.
Figure 11D:
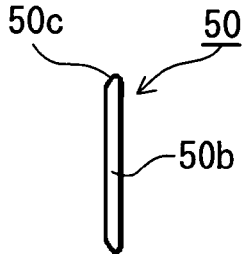
FIG. 11D is a right side view of the partition member.
Figure 11E:
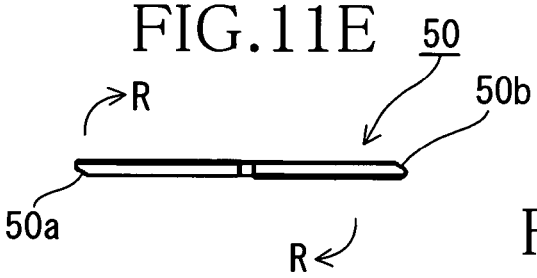
FIG. 11E is a bottom view of the partition member.
Figure 11F:
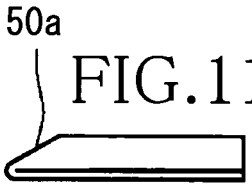
FIG. 11F is an enlarged view of a left end part of FIG. 11A.
Figure 11G:
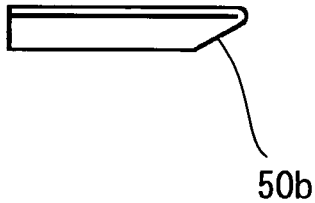
FIG. 11G is an enlarged view of a right end part of FIG. 11A.
Figure 11H:
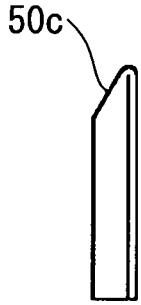
FIG. 11H is an enlarged view of an upper part of FIG. 11A.

When the partition member 50 rotates with the rotor 40 upon the rotation of the rotor 40, it slides in a sliding direction in accordance with a pressing force exerting on the inner surface of the case 31. Thus, the partition member 50 rotates while remaining in contact with the inner surface of the case 31. As the edge portions of the partition member 50 are tapered so as to be thinner toward the edges, when they make contact with the inner surface of the case 31, they flexibly deform to bend in a direction opposite to the rotational direction of the rotor 40 as shown in FIG. 10. Thus, the partition member 50 is in intimate contact with the inner surface of the case 31.

The sliding members 51*a*, 51*b* are thin plate-like members made of acetal polyoxymethylene (POM) resin, thereby the friction resistance generated between the sliding members 51*a*, 51*b* and the rotor 40 is smaller than that generated between the partition member 50 and the rotor 40, as described above. The sliding members 51*a*, 51*b* are interposed between the partition member 50 and the rotor 40.

The partition member 50 and the sliding members 51*a*, 51*b* are disposed such that both end portions of the partition member 50 and the sliding members 51*a*, 51*b* with respect to their longitudinal direction protrude from the peripheral surface of the rotor 40. The partition member 50 can extend and contract in its longitudinal direction because it is a flexible member. The sliding members 51*a*, 51*b* are shorter than the partition member 50 with respect to their longitudinal direction, thereby controlling such as to keep both end surfaces of the sliding members 51*a*, 51*b* from contacting with the inner surface of the case 31.

FIGS. 12A to 12D show rotational positions of the rotor 40 at 0 degrees, 45 degrees, 90 degrees, and 135 degrees, respectively. After the rotational position of the rotor 40 reaches 180 degrees, the partition member 50, rotational symmetry 180 degrees, is located in a similar position as is the case with the rotor 40 is at 0 degrees, except that the chambers 32*a*, 32*b* in FIG. 12 change places.

Figure 12A:
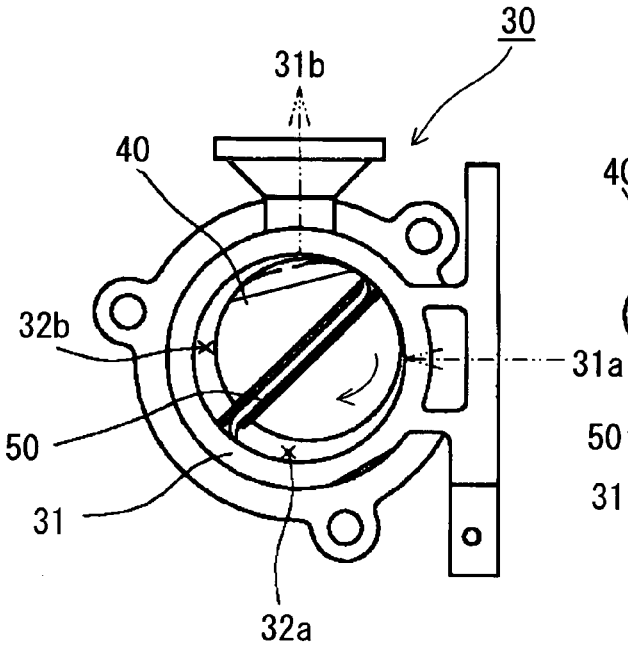
FIGS. 12A-12D show rotational positions of the rotor and the partition member.
Figure 12C:
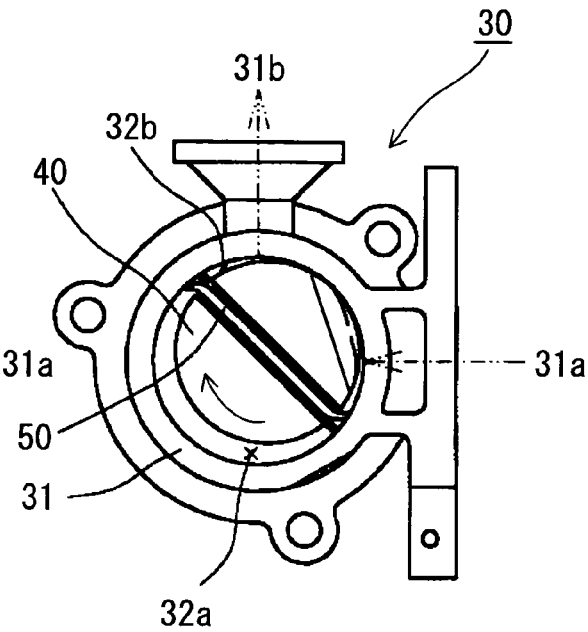
Figure 12B:
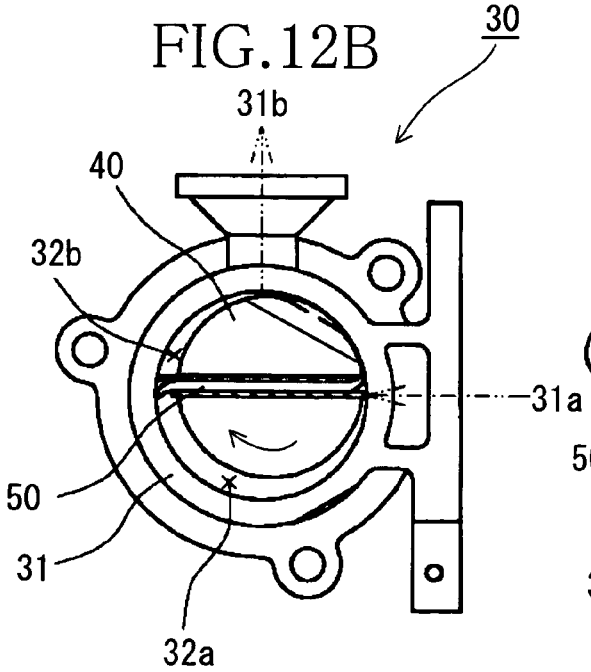
Figure 12D:
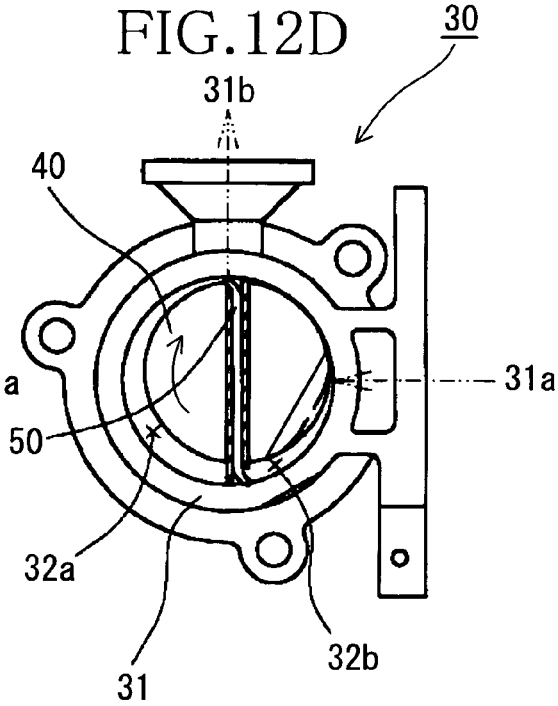
Figure 13A:
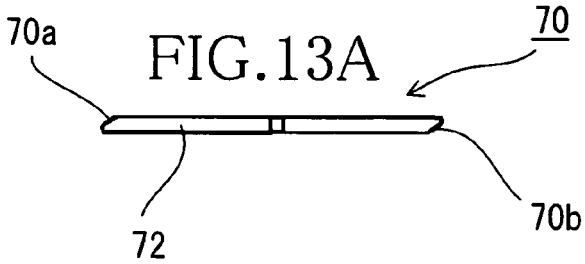
FIG. 13A is a plan view of another partition member.
Figure 13B:
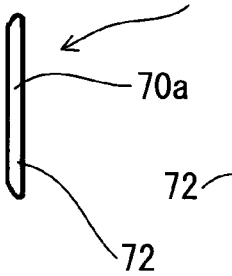
FIG. 13B is a left side view of the partition member.
Figure 13C:
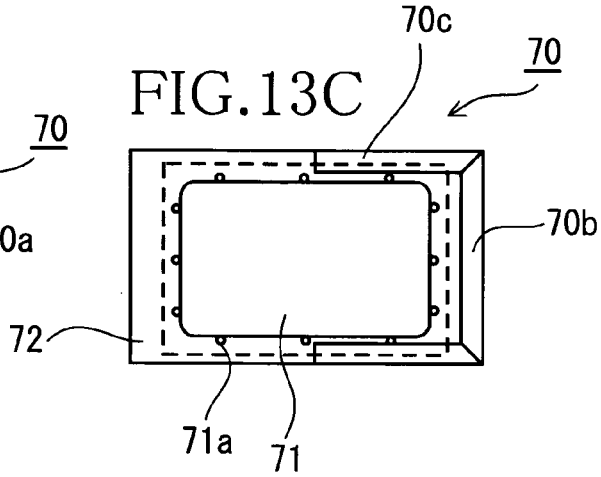
FIG. 13C is a front view of the partition member.
Figure 13D:
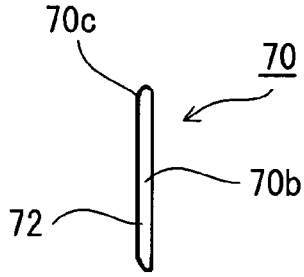
FIG. 13D is a right side view of the partition member.
Figure 13E:
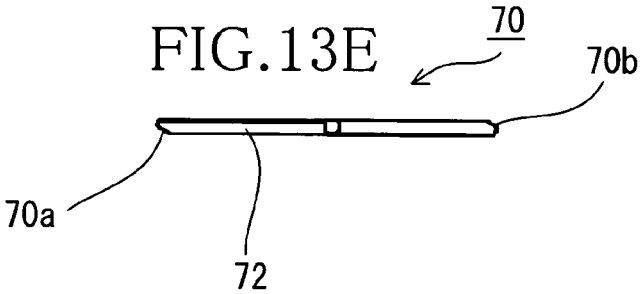
FIG. 13E is a bottom view of the partition member.
Figure 13F:
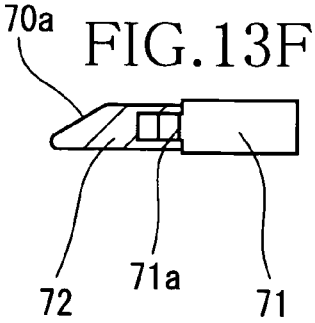
FIG. 13F is an enlarged view of a left end part of FIG. 13A.
Figure 13G:
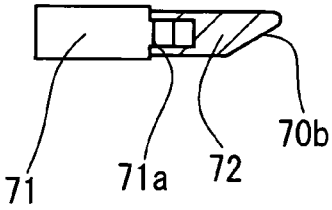
FIG. 13G is an enlarged view of a right end part of FIG. 13A.
Figure 13H:
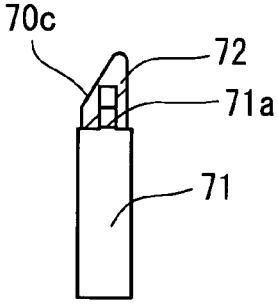
FIG. 13H is an enlarged view of an upper part of FIG. 13A.

When the rotor 40 rotates in the eccentric position in the hollow 32, in the chambers 32*a*, 32*b* partitioned by the partition member 50, the rotor 40, and the case 31, the volume gradually increases at the position communicating with the suction inlet 31*a*, and ink is sucked through the suction inlet 31*a* with the increase of the volume (refer to the chamber 32*a* in FIGS. 12A and 12B). When the rotor 40 further rotates, the chamber where ink has been sucked reaches a position where there is no communication with the suction inlet 31*a* (refer to the chamber 32*a* in FIG. 12C), and then reaches a position communicating with the exhaust outlet 31*b* (refer to the chamber 32*a* in FIG. 12D). In the chamber that reaches the position communicating with the exhaust outlet 31*b*, the volume is gradually decreased, and ink is sent through the exhaust outlet 31*b* with the decrease of the volume (refer to the chamber 32*b* in FIGS. 12A to 12D).

As described above, according to the pump 30, the partition member 50 maintains in contact with the inner surface of the case 31 by sliding in the sliding direction in accordance with a pressing force that acts on the inner surface of the case 31 accompanied with the rotation of the rotor 40. Thus, the pump 30 is simpler in structure and has less trouble when compared with the relevant prior art pump using two vanes urged by a spring. In addition, as the pump 30 does not use a spring, the number of parts can be decreased and manufacturing costs can be reduced.

In addition, the edges of the partition member 50 deform in the direction opposite to the rotational direction of the rotor 40 in contact with the inner surface of the case 31, so that they are easy to stick to the inner surface of the case. Thus, this enhances the degree of contact (air tightness or fluid tightness) between the partition member 50 and the inner surface of the case 31 and improves the pump performance, when compared with the prior art pump using the two vanes that make contact with the inner surface of the case 31 without deformation.

Especially, the edges of the partition member 50 are tapered toward the edges and the partition member 50 is easy to deform toward the edges. Even when there are minute bumps and dips on the inner surface of the case 31, the partition member 50 is easy to deform to fit the bumps and dips at its edges, and the degree of contact (air tightness or fluid tightness) between the partition member 50 and the inner surface of the case 31 becomes extremely high, when compared with a case without such tapered edges. In addition, differing from a case when the partition member 50 is thin in its entirety, the partition member 50 according to the embodiment does not bend excessively further beyond the edge portions. Thus, the partition member 50 does not bend excessively with the increase of the internal pressure.

Further, as the sliding members 51*a*, 51*b* are interposed between the partition member 50 and the rotor 40, the partition member 50 can smoothly slide with the sliding members 51*a*, 51*b* with respect to the rotor 40. Thus, the movement of the partition member 50 with respect to the rotor 40 becomes smooth, thereby improving the reliability of the pump, when compared with a case without the sliding members 51*a*, 51*b*.

According to the inkjet printer 1 equipped with the pump 30 structured, as described above, the pump 30 is comparatively simple in structure, and can be manufactured with less manufacturing costs by just that much, developing a smaller size of the pump 30 is also easy, malfunction is unlikely to occur, and the pump performance is also excellent. Thus, these factors contributes to reduced manufacturing costs of the inkjet printer 1, enabling the pump to accommodate in a limited space inside the inkjet printer 1 compactly, and preventing trouble such as ink supply failure.

Although the two sliding members 51*a*, 51*b* are adopted in the above embodiment to enhance the slidability of the partition member 50, there may be no need to provide the sliding members 51*a*, 51*b* in the pump 30 if the slidability of the partition member 50 is sufficiently high.

As a structure where the slidability of a partition member can be enhanced sufficiently, a partition member 70 shown in FIGS. 13A to 13H, for example, can be provided where a contact part 72 formed of fluorine rubber is provided around the edges of a core member 71 formed of POM resin.

The partition member 70 is a combination of the core member 71 and the contact part 72, which are integrally formed by the so-called outsert molding technique where the core member 71 is arranged in a mold in advance and then composite raw material of fluorine rubber is injected in the mold so that the contact part 72 is molded. A plurality of through holes 71*a* are formed on the core member 71, and the material to produce the contact part 72 are embedded in the through holes 71*a*. Thus, the core member 71 and the contact part 72 never separate from each other although delamination only occurs at an interface between the core member 71 and the contact part 72. The core member 71 and the contact part 72 are excellent in strength when compared with a case that they are separately produced and bonded with adhesive agent.

Even in the partition member 70 structured above, as is the case with the partition member 50, edge portions of the partition member 70 are cut at a bevel so that slopes (70*a*, 70*b*, 70*c* of FIG. 13) are formed having approximately 30 degrees with respect to the front and back surfaces of the partition member 70, and thereby the edge portions are formed thinner toward the edges. The edge portions of the partition member 70 deform in contact with the inner surface of the case 31 in a direction opposite to the rotational direction of the rotor 40, thereby bringing into intimate contact with the inner surface of the case 31.

The core member 71 is slightly thicker than the contact part 72. When the partition member 70 is disposed in the rotor 40, the front and back surfaces of the core member 71 mainly make contact with the inner surface of the through part 41*a* of the rotor 40. Thus, in contrast with the partition member 50 entirely made of fluorine rubber, the partition member 70 has a sufficiently high slidability relative to the rotor 40 without having to interpose the sliding members 51*a*, 51*b*.

Thus, the partition member 70 can be smoothly slid with respect to the rotor 40 as long as it is structured as described above, when compared with a case that it is constructed of only a material selected in terms of the degree of contact with respect to the case 31. Thus, the reliability of the pump 30 can be improved. In addition, when compared with a case where the partition member is formed of only a material selected in terms of the slidability with respect to the rotor 40, the partition member 70 can be brought in contact with the case 31, thereby improving the pump performance. Furthermore, there is no need to interpose the sliding members 51*a*, 51*b*. The dimensional accuracy of the core material 71 is higher than that of the partition member formed of a rubber-base material, so that a play between the rotor 40 and the partition member 70 can be minimized without detriment to the slidability, and that backlash of the partition member 70 can be controlled. These have also effects to stabilize the operation of the pump 30 and improve the reliability of the pump 30.

A pump concerning the embodiment and modifications of the invention includes a case having a hollow inside defined by an inner wall surface and including a suction inlet through which ink is sucked in the hollow and an exhaust outlet through which ink is ejected from the hollow; a rotor that is rotatable in the hollow and having a through groove formed on the rotor in a direction across the rotor; and a partition that is rotatable with the rotor and slidably supported with respect to the rotor in a direction across the rotor such that edge portions of the partition is in constant contact with the inner wall surface defining the hollow.

According to this structure, when the rotor is rotated, sliding of the partition in the direction across the rotor and expansion and shrinkage of the partition in the direction across the rotor make the edge portions contact with the inner wall surface defining the hollow, thereby ink can be sucked through the suction inlet into the hollow, and the sucked ink can be ejected through the exhaust outlet from the hollow. Accordingly, the pump is simpler in structure and has less trouble when compared with the relevant prior art pump using two vanes urged by a spring instead of the partition. In addition, as the pump does not use a spring, the number of parts can be decreased and manufacturing costs can be reduced.

In the above pump, the rotor is rotatable and in constant or intermittent contact with the specified position of the inner wall surface defining the chamber. When the rotor is in contact with the specified position of the inner wall surface, the hollow is divided into the plurality of chambers each enclosed by the case, the rotor, and the partition, and the suction inlet and the exhaust outlet are present in the respective chambers. When ink is sucked in the hollow through the suction inlet and ejected from the hollow through the exhaust outlet, suction and ejection of ink is conducted efficiently thereby improving the pump performance.

According to the structure, when the rotor is in contact with the specified position of the inner wall surface, the suction inlet and the exhaust outlet are present in the different chambers respectively enclosed by the case, the rotor, and the partition member. Thus, when ink is sucked through the suction inlet inside the hollow and ejected through the exhaust outlet from the hollow, efficiency of suction and ejection of ink is improved thereby the performance of the pump is improved.

In the above pump, sliding members of which sliding friction coefficient between the sliding members and the partition is smaller than a sliding friction coefficient between the rotor and the partition, are disposed such as to place the partition therebetween.

According to the structure, the partition placed between the sliding members slides smoothly with the sliding members with respect to the rotor. When compared with the case where the sliding members are not disposed, the movement of the partition with respect to the rotor accompanied with the rotation of the rotor is smooth and the reliability of the pump is improved.

In the above pump, the length of the sliding members are shorter than that of the partition with respect to the direction across the rotor. According to the structure, as the partition protrudes from both ends of the sliding members, the partition 50, which protrudes from the rotor is not curved excessively at both ends. Thus, the partition becomes easy to slide, thereby enabling stable sealability between the partition and the case as well as preventing the generation of an excessive rotational torque.

The above pump is structured such that, when the suction inlet and the exhaust outlet are on the same side with respect to the partition (in the same chamber in the hollow partitioned by the partition member), a fluid resistance between the suction inlet and the exhaust outlet is variable. According to the structure, a space in the ink tank and an ink passage in the inkjet head are communicated with each other in the pump with a low resistance. During printing, an adequate amount of ink is supplied from the ink tank via the pump in response to ejection of ink to the inkjet head.

On the other hand, by setting the fluid resistance in the chamber too high and rotating the rotor continuously, ink can be forcibly supplied from the ink tank to the inkjet head even when printing is not performed, and bubbles remaining in the inkjet head can be also purged with ink. Thus, with a simple way of making a fluid resistance variable, the inkjet head can cope with both printing and purging.

Contrasted with a case of using a flexible tube, the space in the ink tank and the ink passage in the inkjet head are connected in the pump without separation, thereby preventing trouble such as ink supply failure traceable to pump failure. In addition, as there is no need to provide a flexible tube in the pump, the impermeability for bubbles in the pump can be improved.

The pump may be structured such that the fluid resistance can be changed when the rotor is moved between the position making contact with the specified position on the inner wall surface and the position out of contact with the specified position on the inner wall surface, as shown in the second modification of the invention. According to the structure, when the rotor is in the position making contact with the specified position on the inner wall surface, the fluid resistance is always maintained high even when the rotor is rotated, and there is no reduction in the performance of the pump when purging is performed.

The pump may be structured such that the fluid resistance may be changed when a wall surface near the specified position on the inner wall surface is moved between the position making contact with the rotor and the position out of contact with the rotor, as shown in the third modification of the invention. According to the structure, when the wall surface near the specified position on the inner wall surface is in the position making contact with the rotor, the fluid resistance is always maintained high even when the rotor is rotated, and there is no reduction in the performance of the pump when purging is performed.

The pump may be structured such that the rotor may include a cut portion on the peripheral surface of the rotor and rotate in constant or intermittent contact with the specified position of the inner wall surface defining the chamber, as shown in the embodiment of the invention, and the fluid resistance may be changed in response to the position of the cut portion changing by rotation of the rotor, with respect to the suction inlet and the exhaust outlet. According to the structure, the pump can be manufactured simply by providing the cut portion on the peripheral surface of the rotor.

The pump may be structured such that the rotor may include a tunnel that connects two places on the peripheral surface of the rotor and rotate in constant or intermittent contact with the specified position of the inner wall surface defining the chamber, as shown in the fourth modification of the invention, and the fluid resistance may be changed in response to the position of the tunnel changing by rotation of the rotor, with respect to the suction inlet and the exhaust outlet. According to the structure, the pump can be easily manufactured only by providing the tunnel that connects the two places on the peripheral surface of the rotor.

According to an inkjet printer having the pump disclosed in the above embodiment and modifications, the pump is comparatively simple in structure, can be manufactured with less manufacturing costs by just that much, developing a smaller size of the pump is also easy, malfunction is unlikely to occur, and the pump performance is also excellent. Thus, these factors contributes to reduced manufacturing costs of the inkjet printer, enabling the pump to accommodate in a limited space inside the inkjet printer compactly, and preventing trouble such as ink supply failure.

In this inkjet printer, ink can be supplied from the ink tank to the inkjet head by pressure using the pump. When ink is initially supplied from the ink tank to the inkjet head, it can be filled in a passage from the ink tank to the inkjet head using the pump. When purging is performed to remove thickened ink remaining in the nozzles of the head, ink is forcibly sent to the head using the pump, so that the thickened ink is ejected from the nozzles of the head, thereby restoring the performance of the head.

Furthermore, in the inkjet printer, the rotor is structured such as to stop at a rotational position when the pump is not in operation and has a passage that provides communication between the suction inlet and the exhaust outlet at the stopped state. When ink is ejected from the head in the stopped state of the rotor, ink is supplied from the ink tank via the passage to the head.

According to the inkjet printer structured above, the rotor built in the pump is structured at the rotational position when the pump is not in operation, and the suction inlet and the exhaust outlet are in communication with each other via the passage. When ink is ejected from the head, ink is supplied from the ink tank to the head via the passage, and the pump never hinders the flow of ink.

That is, in this kind of the inkjet printer, when ink is ejected from the head, for example, to execute usual printing, ink is accordingly decreased from the ink passage in the head, the pressure of the ink passage in the head is lowered, a difference in pressure is generated between the ink tank side and the head side, and ink flows from the ink tank to the head. In this case, if the pump is structured to interrupt the flow of ink between the ink tank and the head, a bypass passage should be provided to detour the pump and to secure the passage form the ink tank to the head.

However, as the pump includes a rotor having a passage structured above, there is no need to provide a bypass passage, and the ink passage can be secured from the ink tank to the head. Thus, the structure of the ink passage is simplified by just that much, and this also contributes to reduced manufacturing costs and improved maintenance of the inkjet printer.

In the inkjet printer concerning the embodiment and modifications of the invention, a metal needle having a fluid passage inside is directly connected to the suction inlet and the tip of the needle is stuck in the ink tank. According to the structure, as the metal needle only is disposed between the ink tank and the pump, air bubbles are hardly trapped in ink between the ink tank and the pump.

In addition, the above inkjet printer includes an ink passage connecting the pump and the inkjet head. The ink passage is formed with a portion that is connected to the exhaust outlet and faces toward a vertical direction, and a filter is disposed in the portion such that a filter face is placed horizontally.

According to the structure, as the filter is disposed in the portion that is connected to the exhaust outlet and faces toward the vertical direction with its filter face positioned horizontally, bubbles trapped in ink when ink is initially let in the empty hollow of the pump, for example, are to easily pass through the filter, because a comparatively great force combining the buoyancy of the bubbles and the rotation force of the pump is applied to the bubbles in ink. Thus, ink supply to the inkjet head is less often interrupted due to stagnation of a large amount of bubbles at an upstream side of the filter.

In the above inkjet printer, the exhaust outlet is formed on an upper vertical side of the case. According to the structure, bubbles trapped in the hollow when ink is initially let in can be smoothly ejected without opposing the buoyancy, thereby obtaining a high ejection quality.

In the pump according to the embodiment and modifications of the invention, both ends, at least, of the partition make contact with the inner wall surface of the case, and flexibly deform to bend in a direction opposite to the rotational direction of the rotor. Thus, the partition is in intimate contact with the inner surface of the case. According to the structure, both ends, at least, of the partition member are fully in intimate contact with the inner wall surface of the case. Thus, this enhances the degree of contact (air tightness or fluid tightness) between the partition and the inner wall surface of the case and improves the pump performance, when compared with the prior art pump using the two vanes that make contact with the inner surface of the case without deformation. Furthermore, as the flexure of the partition increases, the partition slides less in the rotor compared with a non-flexible partition of the same length. Thus, the motion of the rotor becomes smooth Further, in the pump, the partition is shaped thinner toward the edges. According to the structure, the partition is likely to deform toward the edges. Even when there are minute bumps and dips on the inner wall surface of the case, the partition is easy to deform to fit the bumps and dips at its edges, and the degree of contact (air tightness or fluid tightness) between the partition and the inner wall surface of the case becomes extremely high, when compared with a case without such tapered edges. In addition, differing from an entirely thin partition member, the partition does not bend excessively further beyond the edge portions. Thus, the partition does not bend excessively with the increase of the internal pressure.

In the pump, the partition has a first portion formed of a first material that allows the first portion to flexibly deform in contact with the case and a second portion formed of a second material that allows the second portion to deform less flexibly than the first portion, and a friction resistance between the first portion and the rotor is greater than a friction resistance between the second portion and the rotor.

In the pump thus structured, the first material is preferably a material excellent for contact mainly with the case, that is, a rubber-base material, such as fluorine rubber, ethylene-propylene-diene-terpolymer (EPDM)-base rubber, styrene butadiene rubber (SBR), nitrile-butadiene rubber (NBR), and chloroprene rubber (CR). Above all, fluorine rubber is preferable in its high slidability. The second material is preferably a material with low friction resistance and high wear resistance, for example, an engineering resin such as acetal polyoxymethylene (POM), poly-carbonate (PC) resin, polypropylene (PP) resin, and polyethylene (PE) resin.

For the first portion, a portion required for contact mainly with the case is selected. For the second portion, a portion required for small friction resistance mainly to the rotor is selected. For example, the partition member may be made up of a core member formed of the second material and a contact portion formed of the first portion, which is shaped like a frame around the core material, in order that the edges are formed of the first material and the front and back surfaces are formed of the second material. In this case, the partition member is preferably structured such that the front and back surfaces of the core member are thickened more than the contact portion, in order that the rotor can make contact with the front and back surfaces of the core member mainly, and the contact portion around the core member can make intimate contact with the inner wall surface of the case. Alternatively, the structure of the partition member may be that projections formed of the second material may protrude from the front and back surfaces formed of the first material. The first portion and the second portion can be designed in any form or any size as long as they can play their own roles. No matter how the partition member is shaped in a concrete manner, the partition member formed of two materials can improve both the degree of contact with the case and the slidability relative to the rotor, compared with formation of a single material.

According to the pump, the partition can be slid smoothly with respect to the rotor thereby improving the performance of the pump, compared with a case of forming the partition of a material selected in terms of the degree of contact with the case.

The first portion and the second portion can be molded separately and bonded later if the materials of the first portion and the second portion are a combination to provide high adhesion properties to each other. However, combinations of rigid cellular plastics and rubbers do not generally in most provide high adhesion. In this case, it is preferable that the first portion and the second portion are integrally formed by insert molding (sometimes called outsert molding) in such a manner that they never separate from each other although delamination only occurs at an interface therebetween.

What is claimed is:

1. A pump, comprising:

a case having a hollow inside defined by an inner wall surface thereof and including a first through hole through which fluid is sucked in the hollow and a second through hole through which the fluid is ejected from the hollow;

a rotor that is rotatable in the hollow and having a rotary shaft and a through groove formed on the rotor in a direction across the rotary shaft; and a partition supported in the through groove slidably in the direction across the rotary shaft, the partition being rotatable with the rotor with at least both ends of the partition, with respect to the direction across the rotary shaft, in constant contact with the inner wall surface defining the hollow upon rotation of the rotor, wherein:

the hollow is partitioned into a plurality of chambers each enclosed by the case, the rotor, and the partition member;

the rotor and the case are structured such that at least one of the rotor and the case selectively moves between a first position where the rotor is in contact with the inner wall surface defining the hollow during a purging operation and a second position where the rotor and the inner wall surface are separate from each other during a printing operation;

during the purging operation when the rotor rotates and makes contact with the inner wall surface, the first through hole and the second through hole are present in different chambers; and during the printing operation, the rotor stops at a rotational position where the first through hole and the second through hole are in fluid communication with each other.

2. The pump of claim 1, further comprising:

a sliding member that is disposed on each side of the partition, wherein a sliding friction resistance between the sliding member and the through groove of the rotor is smaller than a sliding friction resistance between the through groove of the rotor and the partition.

3. The pump of claim 2, wherein a length of the sliding member is shorter than a length of the partition with respect to the direction across the rotor.

4. The pump of claim 1, wherein the rotor selectively moves between the first position and the second position, and the fluid resistance is changed when the rotor is moved between the first position and the second position.

5. The pump of claim 1, wherein the case selectively moves between the first position and the second position, and the fluid resistance is changed when a part of the case is moved between the first position and the second position.

6. The pump of claim 1, wherein the rotor has a cut portion on an outer peripheral surface around the rotor and the rotor rotates in intermittent contact with the inner wall surface defining the hollow, and the fluid resistance is changed in accordance with a position of the cut portion changing by rotating of the rotor with respect to the first through hole and the second through hole.

7. The pump of claim 1, wherein the second through hole is formed on an upper vertical side of the case.

8. The pump of claim 1, wherein at least both ends of the partition flexibly deform to bend in a direction opposite to the rotational direction of the rotor in contact with the inner wall surface of the case and closely make contact with the inner wall surface of the case.

9. The pump of claim 8, wherein the partition is shaped thinner toward edge portions.

10. The pump of claim 8, wherein the partition has a first portion formed of a first material that allows the first portion to flexibly deform in contact with the case and a second portion formed of a second material that allows the second portion to deform less flexibly than the first portion, and a friction resistance between the first portion and the rotor is greater than a friction resistance between the second portion and the rotor.

11. The pump of claim 1, wherein a metal needle having a fluid passage inside is directly connected to the first through hole.

12. The pump of claim 1, wherein when the rotor is stopped at a rotational position during the printing operation, the rotor has a passage that provides communication between the first through hole and the second through hole.

13. An inkjet printer comprising:

an inkjet head that ejects ink toward a recording medium;

an ink tank that contains ink for supplying the inkjet head;

a pump, comprising:

a case having a hollow inside defined by an inner wall surface thereof and including a first through hole through which fluid is sucked in the hollow and a second through hole through which the fluid is ejected from the hollow;

a rotor that is rotatable in the hollow and having a rotary shaft and a through groove formed on the rotor in a direction across the rotary shaft; and a partition supported in the through groove slidably in the direction across the rotary shaft, the partition being rotatable with the rotor with at least both ends of the partition, with respect to the direction across the rotary shaft, in constant contact with the inner wall surface defining the hollow upon rotation of the rotor, wherein:

the pump is connected between the inkjet head and the ink tank, and the hollow is partitioned into a plurality of chambers each enclosed by the case, the rotor, and the partition;

the rotor and the case are structured such that at least one of the rotor and the case selectively moves between a first position where the rotor is in contact with the inner wall surface defining the hollow during a purging operation and a second position where the rotor and the inner wall surface are separate from each other during a printing operation;

during the purging operation when the rotor rotates and makes contact with the inner wall surface, the first through hole and the second through hole are present in different chambers; and during the printing operation, the rotor stops at a rotational position where the first through hole and the second through hole are in fluid communication with each other.

14. The inkjet printer of claim 13, wherein a metal needle having a fluid passage inside is directly connected to the first through hole and a tip of the needle is stuck in the ink tank.

15. The inkjet printer of claim 13, wherein an ink passage connecting the pump and the inkjet head is formed with a portion that is connected to the second through hole and faces toward a vertical direction, and a filter is disposed in the portion such that a filter face is placed horizontally.

16. The inkjet printer of claim 13, wherein the second through hole is formed on an upper vertical side of the case.

17. The inkjet printer of claim 13, wherein during the printing operation, the rotor has a passage that provides communication between the first through hole and the second through hole with the rotor stopped at the rotational position, and when ink is ejected from the inkjet head with the rotor stopped at the rotational position, ink is supplied from the ink tank via the passage to the inkjet head.

18. A pump, comprising:

a case having a hollow inside defined by an inner wall surface thereof and including a first through hole and a second through hole through which the fluid is ejected from the hollow;

a rotor that is rotatable in the hollow and having a rotary shaft and a through groove formed on the rotor in a direction across the rotary shaft; and a partition supported in the through groove slidably in the direction across the rotary shaft, the partition being rotatable with the rotor with at least both ends of the partition member, with respect to the direction across the rotary shaft, in constant contact with the inner wall surface defining the hollow upon rotation of the rotor, wherein:

the rotor and the case are structured such that the rotor and the case selectively move between a first position where the rotor is in contact with the inner wall surface defining the hollow during a purging operation and a second position where the rotor and the inner wall surface are separate from each other during a printing operation;

during the purging operation when the rotor rotates and makes contact with the inner wall surface, the first through hole and the second through hole are present in different chambers; and during the printing operation, the rotor stops at a rotational position where the first through hole and the second through hole are in fluid communication with each other.

19. A pump, comprising:

a case having a hollow inside defined by an inner wall surface thereof and including a first through hole through which fluid is sucked in the hollow and a second through hole through which the fluid is ejected from the hollow;

a rotor that is rotatable in the hollow and having a rotary shaft and a first through groove and a second through groove formed on the rotor in a direction across the rotary shaft;

a partition supported in the first through groove slidable in the direction across the rotary shaft, the partition being rotatable with the rotor with at least both ends of the partition, with respect to the direction across the rotary shaft, in constant contact with the inner wall surface defining the hollow upon rotation of the rotor, wherein:

a first end of the second through groove is adjacent to the first through hole and a second end of the second through groove is adjacent to the second through hole in order to provide fluid communication between the first through hole and the second through hole when the rotor is not rotating during a printing operation, and the first end and the second end of the second through groove move to a side of the partition opposite a side with the first through hole and the second through hole when the rotor is rotating during a purging operation.

20. A pump, comprising:

a case having a hollow inside defined by an inner wall surface thereof and including a first through hole through which fluid is sucked in the hollow and a second through hole through which the fluid is ejected from the hollow;

a rotor that is rotatable in the hollow and having a rotary shaft and a through groove formed on the rotor in a direction across the rotary shaft; and a partition supported in the through groove slidably in the direction across the rotary shaft, the partition being rotatable with the rotor with at least both ends of the partition, with respect to the direction across the rotary shaft, in constant contact with the inner wall surface defining the hollow upon rotation of the rotor, wherein:

the hollow is partitioned into a plurality of chambers each enclosed by the case, the rotor, and the partition, the rotor has a communication passage connecting two places on an outer peripheral surface and the rotor rotates in constant contact with the inner wall surface defining the hollow, and the rotor is structured that the rotor selectively moves between a first position where the communication passage is located on a side of the partition with the first through hole and the second through hole in order to provide fluid communication between the first through hole and the second through hole when the rotor is not rotating during a printing operation and a second position where the communication passage is not located on the side of the partition with the first through hole and the second through hole as the rotor rotates during a purging operation.

* * * * *